United States Patent [19]

Young

[11] 4,180,132

[45] Dec. 25, 1979

[54] SERVICE SEAL UNIT FOR WELL PACKER

[75] Inventor: Carter R. Young, Lewisville, Tex.

[73] Assignee: Otis Engineering Corporation, Dallas, Tex.

[21] Appl. No.: 920,284

[22] Filed: Jun. 29, 1978

[51] Int. Cl.[2] ..... E21B 33/128; E21B 33/129

[52] U.S. Cl. ..... 166/120; 166/125; 166/129; 166/183

[58] Field of Search ..... 166/120, 123, 124, 125, 166/129, 130, 183

[56] References Cited

U.S. PATENT DOCUMENTS

| | | | |
|---|---|---|---|
| 3,002,561 | 10/1961 | Baker et al. | 166/120 |
| 3,072,204 | 1/1963 | Brown | 166/120 |
| 3,253,655 | 5/1966 | Brown | 166/120 |
| 4,049,055 | 9/1977 | Brown | 166/123 |

*Primary Examiner*—James A. Leppink
*Attorney, Agent, or Firm*—H. Mathews Garland

[57] ABSTRACT

A well packer and service seal unit for setting the packer in a well bore and depositing a gravel or slurry pack within the well bore. The packer includes a tubular mandrel connectible with a tubing handling string and adapted to support a gravel pack sand screen below the packer, a setting sleeve, top slips, bottom slips, internal slips, and seal elements supported on the mandrel for holding the packer in a well casing against a pressure differential in either direction and sealing with the casing to isolate a producing zone in the well bore. The service seal unit is insertable into the packer for supporting the packer as it is lowered in the well bore, setting the packer, and directing fluid flow to place the gravel or slurry pack in the well bore around the screen below the packer seal elements. The service seal unit includes a top sub, a tubular housing, a cross-over packing sub, a J-slot mandrel, cross-over weldments, an operating cylinder and piston, a setting sleeve, and upper and lower packing mandrels. The service seal unit also includes spring loaded lugs which inhibit the packer from setting if it becomes wedged in the bore hole during installation. The service seal unit is particularly adapted to set the packer by hydraulic pressure. In operation the service seal unit is telescoped into the packer at the surface end of the well bore, supported on the tubing string, and the service seal unit supported packer is then lowered to the proper depth in the well bore where the packer is set by hydraulic pressure applied to the service seal unit through the tubing string. The gravel pack or slurry pack is then pumped through the tubing string and outwardly into the well bore through the service seal unit and packer below the seal elements on the packer. Thereafter the service seal unit is retrieved and a production tubing string is coupled into the packer for producing the well.

6 Claims, 48 Drawing Figures

SERVICE SEAL UNIT FOR WELL PACKER

This invention relates to well tools and more particularly relates to a hydraulically operable service seal unit useful for setting a well packer in a well bore particularly for placing a gravel or slurry pack in the well bore for well production purposes.

The placing of gravel and slurry packs in well bores is standard practice for improved oil production conditions in such well bores. One type of apparatus which has been available for the setting of packers and placing of gravel and slurry packs is mechanically operated. A principal disadvantage of this type of apparatus is that under some conditions such as deviated bore holes it is difficult to transmit sufficient force downhole from the surface end of the well bore to set the packer at the desired depth. Due to the bore hole deviation binding along the tubing string supporting the packer interferes with the ability to transmit the necessary mechanical force. Thus it is advantageous to be able to set the packer hydraulically since mechanical binding of the tubing string does not interfere with hydraulic transmission of the required packer setting force. The hydraulic setting of packers for the purposes of the invention is not broadly new though the packer systems which are presently available have major design faults. Such prior systems include the holding of the packer in the unset condition by shear pins which are secured with external members of the packer in such a manner that premature setting of the packer is a major problem as the packer is moved along particularly a deviated bore hole. Further, in existing similar systems, the hydraulic mechanism for setting the packer remains in the bore hole when the setting tool is removed and includes seals which present potential future problems of deterioration and fouling by sand, debris, and the like.

It is, therefore, a particularly important object of the invention to provide new and improved apparatus for the setting of a well packer especially adapted for gravel and slurry pack well completion procedures.

It is another object of the invention to provide a new and improved hydraulic device for setting well packers.

It is a further object of the invention to provide a hydraulic device for setting a well packer wherein the packer is held in unset condition by internal structure not affected by obstructions in a bore hole which engage ordinary shear external shear pins used to pin a packer in unset condition.

It is another object of the invention to provide a hydraulic service seal unit for setting a well packer wherein the packer is set by movement of only the hydraulic piston in the service seal unit.

It is another object of the invention to provide apparatus for the hydraulic setting of a well packer wherein the hydraulically operable parts including the seals associated therewith are a part of the service seal unit not the packer and are thereby moved from the bore hole after the packer is set.

In accordance with the invention there is provided a service seal unit for hydraulically setting a well packer comprising a tubular mandrel defining longitudinal central and separate annular flow passages, a fluid crossover valve for connecting the annular flow passage with a well annulus, means for connecting the upper end of the device with a tubing string, a hydraulic cylinder and piston assembly on the mandrel including releasable coupling means for connecting the piston with the setting sleeve of the well packer to set the packer and for restraining the setting sleeve against premature setting, means on the mandrel for releasably connecting the device with a packer for supporting the packer while operating the setting mechanism of the packer, and means supported with the mandrel for establishing fluid circulation from the bore of the mandrel through the packer into the well bore and return upwardly through the separate annular flow passage along the unit back into the well bore above the packer.

The foregoing objects and advantages together with the specific details of a preferred form of the invention will be better understood from the following detailed description taken in conjunction with the accompanying drawings wherein.

Figure 5A:
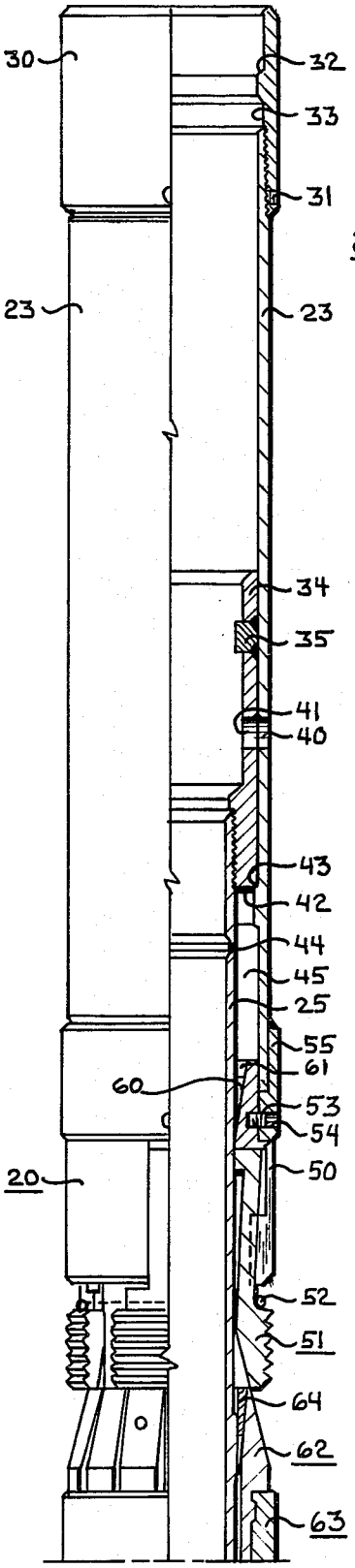
Figure 5B:
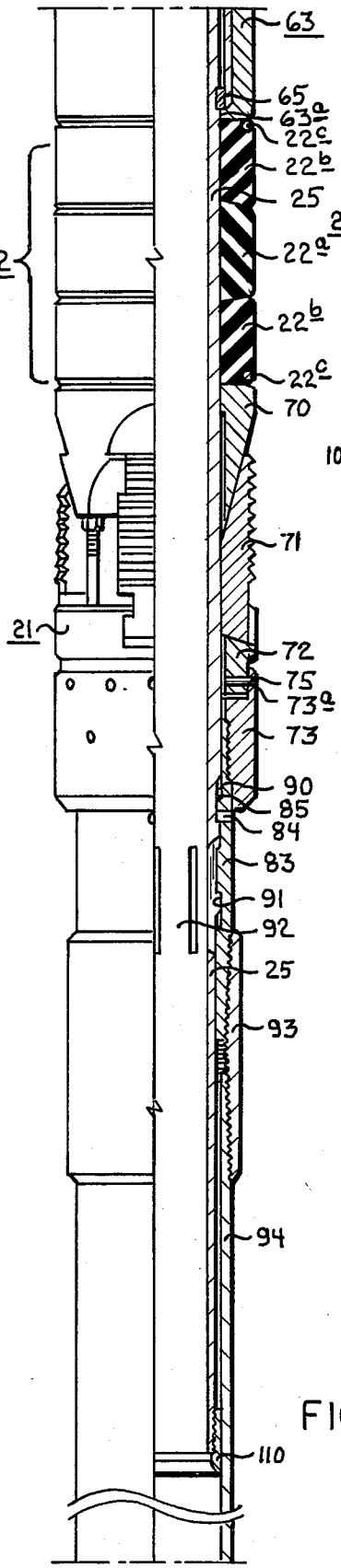
Figure 5C:
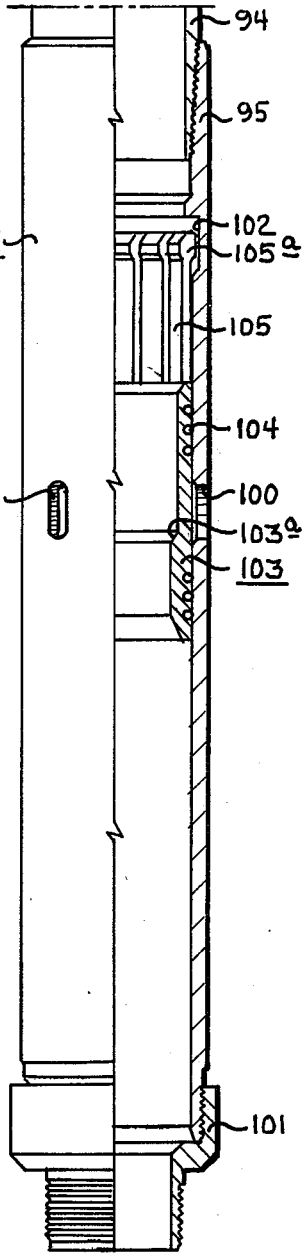
Figure 5B:
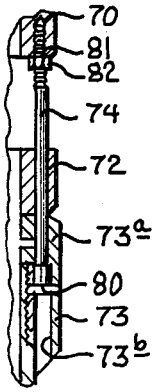
Figure 6A:
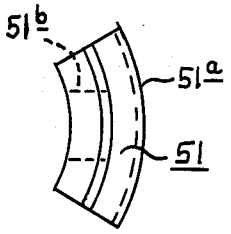
Figure 6B:
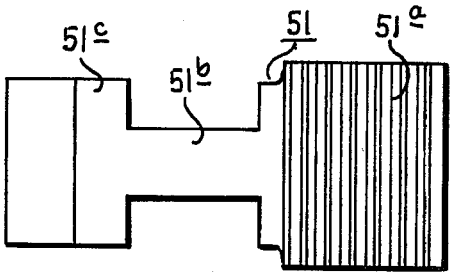
Figure 6C:
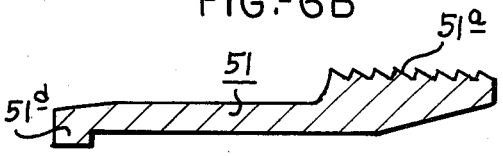
Figure 6D:
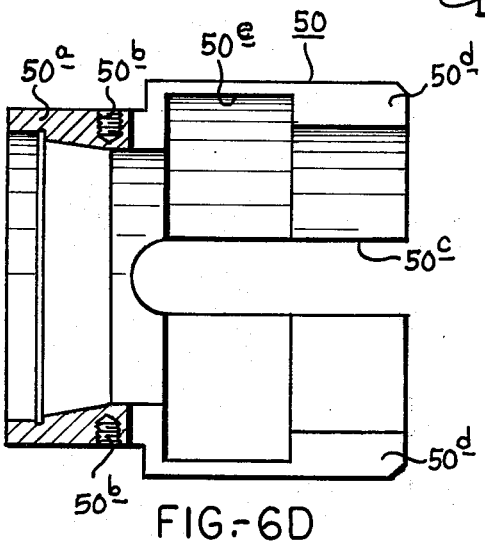
Figure 6E:
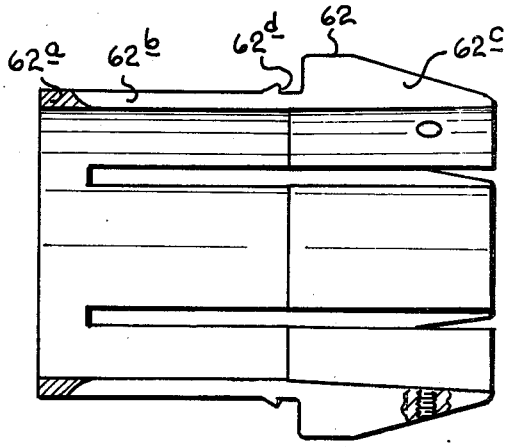
Figure 6F:
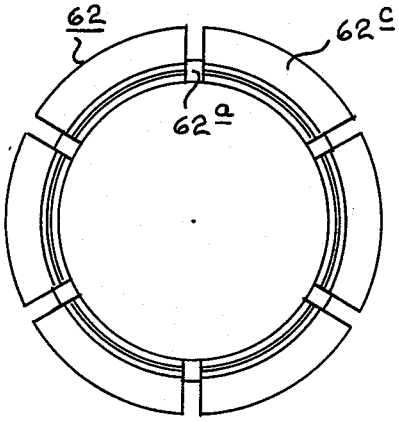
Figure 7A:
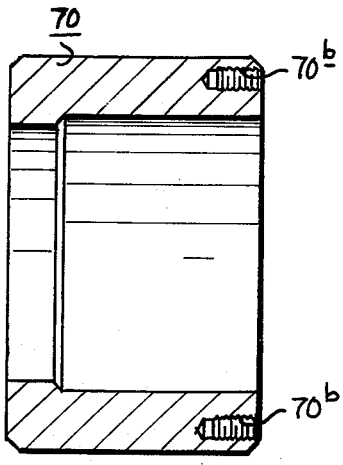
Figure 7B:
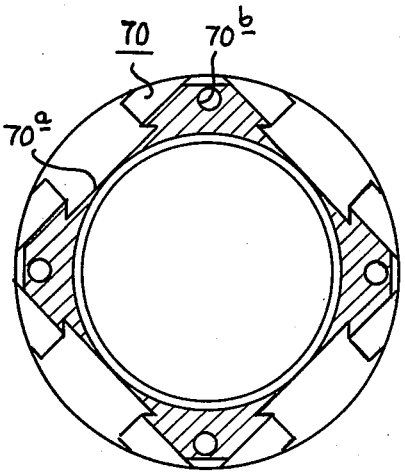
Figure 7C:
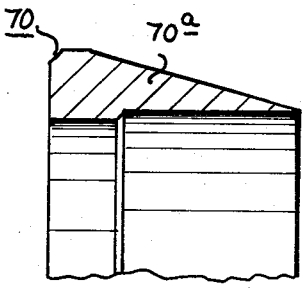
Figure 7D:
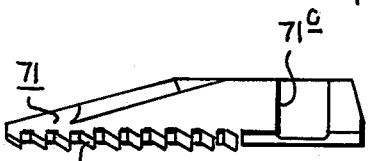
Figure 7E:
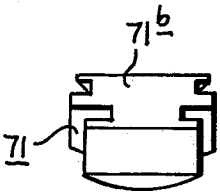
Figure 7F:
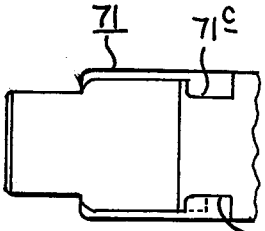
Figure 7G:
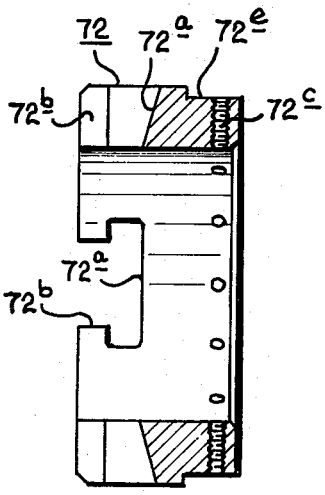
Figure 7H:
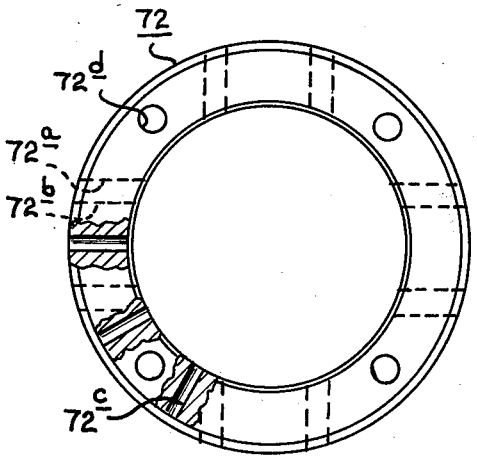
Figure 8A:
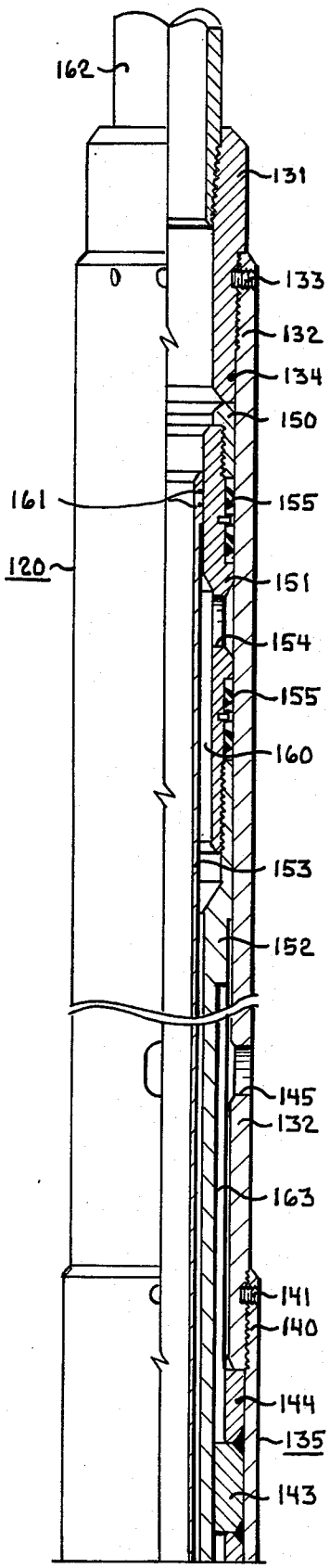
Figure 8B:
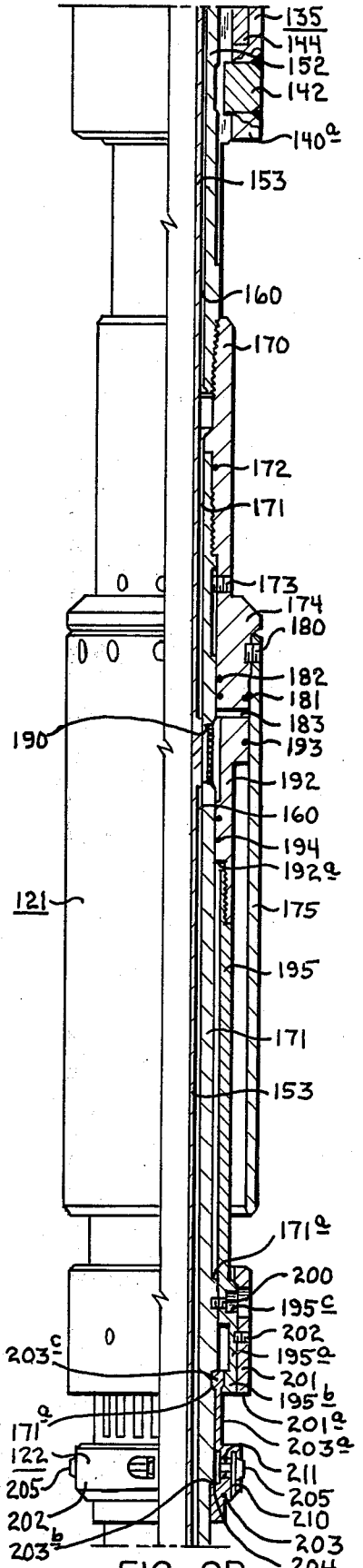
Figure 8C:
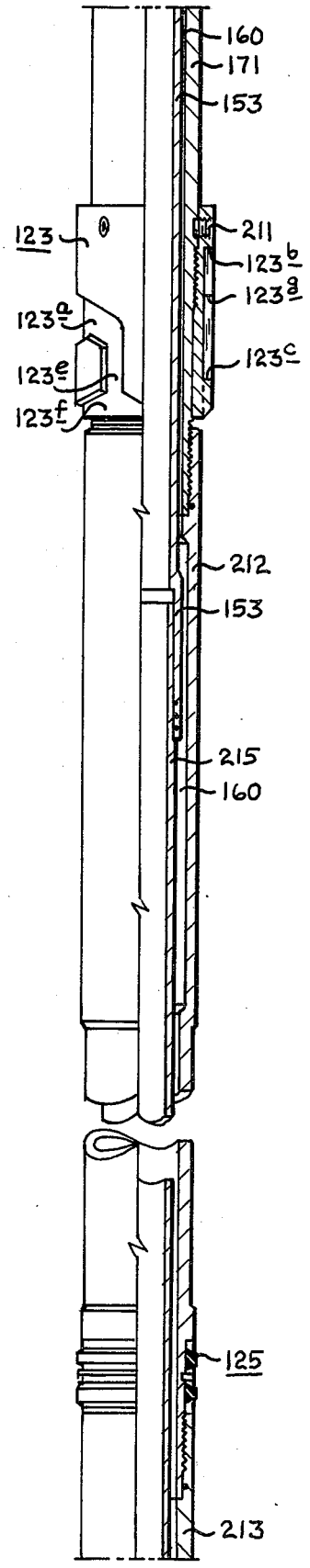
Figure 8D:
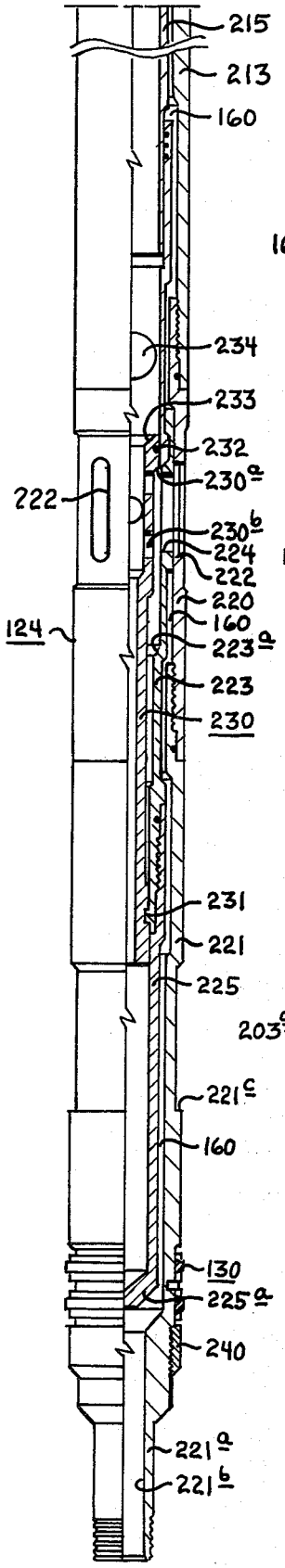
Figure 8B:
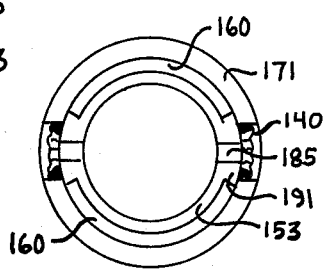
Figure 8D:
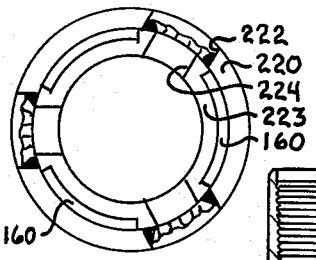
Figure 9E:
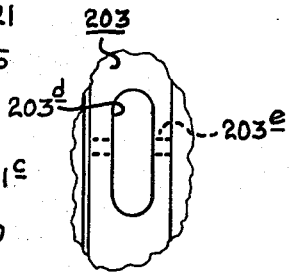
Figure 9A:
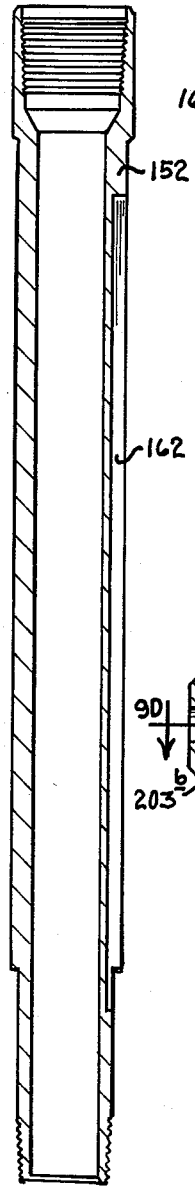
Figure 9B:
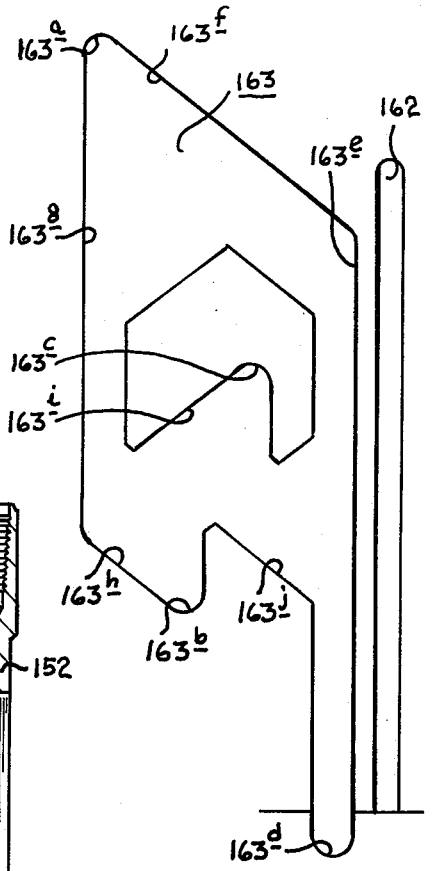
Figure 9C:
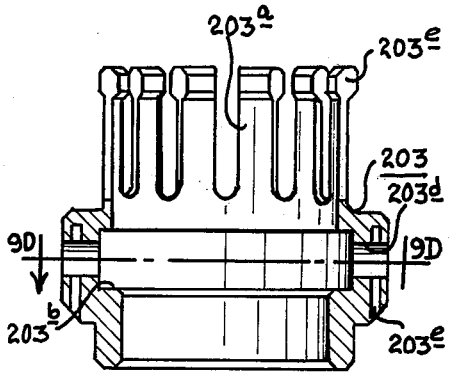
Figure 9D:
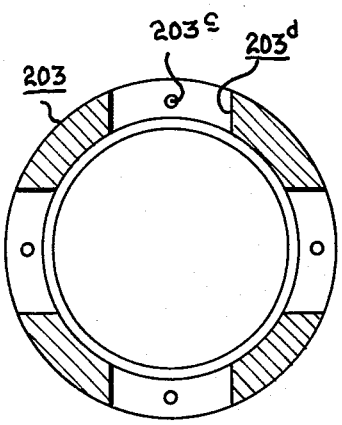
Figure 9I:
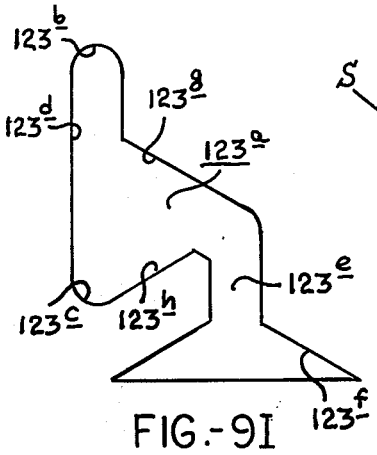
Figure 9F:
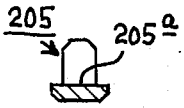
Figure 9H:
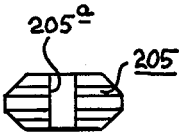
Figure 9G:
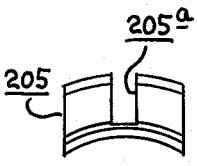

FIGS. 5A, 5B, and 5C taken together are a longitudinal view in section and elevation of a well packer used with the service seal unit of the invention;

FIG. 5BB is a fragmentary view in section of a portion of the lower packer slip assembly as shown in FIG. 5B;

FIG. 6A is a top end view of one of the top slips of the packer of FIGS. 5A–5C;

FIG. 6B is an outside side view of one of the top slips of the packer;

FIG. 6C is a longitudinal view in section of the top packer slip shown in FIGS. 6A and 6B;

FIG. 6D is a longitudinal view in section and elevation of the top slip carrier ring of the packer;

FIG. 6E is a longitudinal view in section and elevation of the top slip collet wedge of the packer;

FIG. 6F is a right end view in elevation of the top slip collet wedge as shown in FIG. 6E;

FIG. 7A is a longitudinal view in section of the lower slip mandrel of the packer taken along a plane between the longitudinal slip slots on the mandrel;

FIG. 7B is a right end view in elevation of the lower slip mandrel;

FIG. 7C is a fragmentary longitudinal view in section of the lower slip mandrel taken along a plane extending along the center line of one of the slip slots;

FIG. 7D is a side view in elevation of one of the lower slips of the packer;

FIG. 7E is a right end view in elevation of the slip shown in FIG. 7D as seen in a plane perpendicular to the plane of the inside tapered face of the slip;

FIG. 7F is a fragmentary top inside view of the slip shown in FIG. 7D;

FIG. 7G is a longitudinal view in section and elevation along a diameter of the lower slip carrier of the packer;

FIG. 7H is a right end view partially broken away in section of the lower slip carrier of FIG. 7G;

FIGS. 8A, 8B, 8C, and 8D taken together are a longitudinal view in section and elevation of the service seal unit of the invention;

FIG. 8BB is an enlarged view in section at the ports into the piston-cylinder assembly shown in FIG. 8B;

FIG. 8DD is an enlarged view in section at the side ports in the valve assembly shown in FIG. 8D;

FIG. 9A is a longitudinal view in section of the J-slot mandrel of the unit shown in FIG. 8A;

FIG. 9B is a development in a single plane of the configuration of the J-slot and the straight slot in the mandrel of FIG. 9A;

FIG. 9C is a longitudinal view in section and elevation of the collet of the latch assembly of the unit shown in FIG. 8B;

FIG. 9D is a view in section of the collet along the line 9D–9D of FIG. 9C;

FIG. 9E is a fragmentary side view in elevation showing one of the transverse latch lug slots of the collet;

FIG. 9F is a view in section of one of the latching lugs of the packer operating sleeve latch assembly of the service seal unit;

FIG. 9G is an end view in elevation of the latch lug shown in FIG. 9F;

FIG. 9H is a top view in elevation of the latch lug shown in FIG. 9G;

FIG. 9I is a development in a single plane of the configuration of the J-slot in the J-latch body of the service seal unit shown in FIG. 8C;

FIGS. 10A, 10B, 10C, 10D and 10E taken together are a longitudinal view in section and elevation of the service seal unit of the invention and the packer of FIGS. 5A–5C showing the seal unit telescoped into and connected with the packer preparatory to running the packer on a handling string; and FIGS. 11A, 11B, 11C, 11D and 11F taken together are a longitudinal view in section of the seal unit in the packer illustrating the packer set within a fragmentary section of the casing in a well bore.

Figure 1:
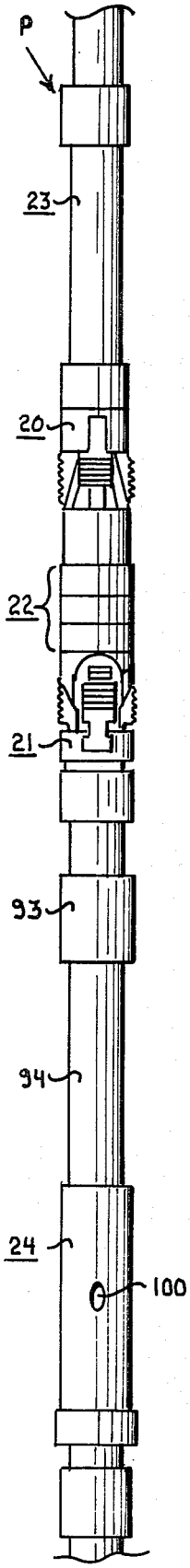
FIG. 1 is a longitudinal schematic view in elevation of a well packer used with the service seal unit of the invention.
Figure 2:
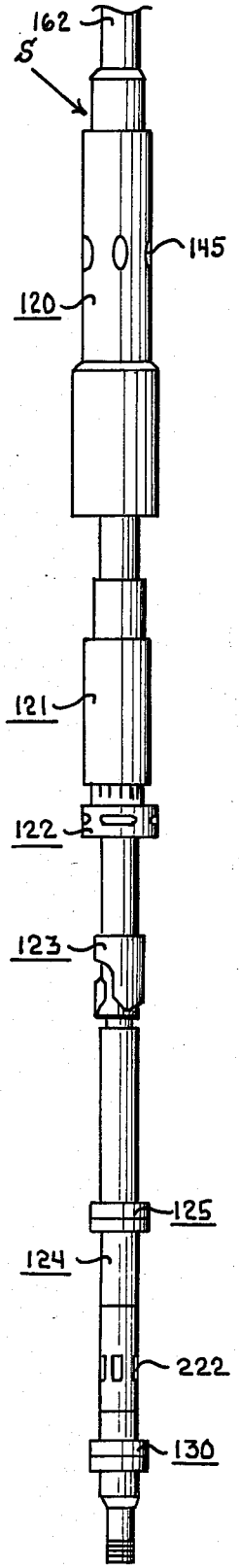
FIG. 2 is a longitudinal schematic view in elevation of a service seal unit constructed in accordance with the invention.
Figure 3:
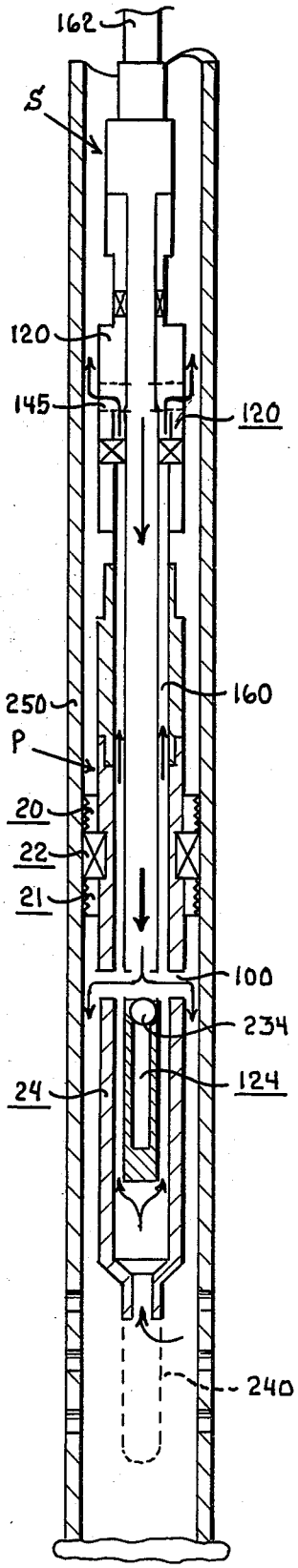
FIG. 3 is a longitudinal schematic view in section of the well packer and service seal unit of FIGS. 1 and 2 coupled together supported in a well bore with the packer set and showing the flow of a gravel or slurry pack through the system into the well bore.
Figure 4:
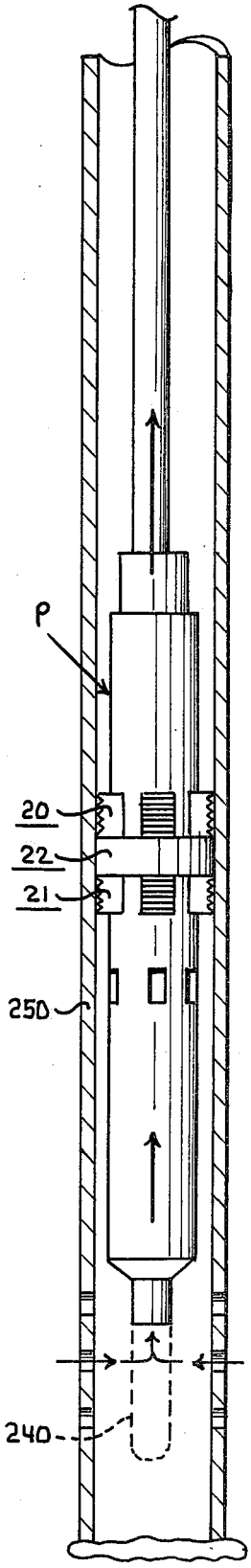
FIG. 4 is a longitudinal schematic view in elevation of a producing well after completion of the gravel or slurry pack, removal of the service seal unit, and connection of a production seal unit for conducting producing fluids from the well through the packer to the surfaces.

Referring to FIGS. 1–4 of the drawing, a packer P as shown in FIG. 1 is adapted to be run and hydraulically set in a well bore by a service seal unit S embodying the features of the invention as shown in FIG. 2. Once the packer is set in a well casing as illustrated in FIG. 3, the service seal unit of the invention remains coupled with the packer while gravel is pumped through the service seal unit and the packer into the well bore below the expanded seal elements of the packer to form a gravel pack within the well casing. The service seal unit is thereafter removed and replaced with a production seal unit for producing the well through the gravel pack and packer into the tubing string. The structure of the service seal unit of the invention permits running of the packer without prematurely setting the packer and hydraulically setting the packer when at the proper depth in the well bore.

Referring to FIG. 1, the packer P includes upper and lower slip assemblies 20 and 21 respectively for locking the packer in a well casing against movement in either direction, an expandible seal assembly 22 between the slip assemblies for forming a fluid tight seal around the packer with the inner wall surface of a well tubing string, a setting sleeve 23 for setting the upper and lower slips and for expanding the seal element, and a closing sleeve assembly on the lower end of the packer for closing off communication through the side of the packer when the service seal unit is removed.

Referring to FIGS. 5A, 5B, and 5C, the setting sleeve, upper slip assembly, seal assembly, and lower slip assembly are all mounted on a tubular mandrel 25 which has a central longitudinal bore defining a flow passage throughout the length of the packer. As shown in FIG. 5A, a tubular guide 30 is threaded on the upper end of the setting sleeve 23 secured by circumferentially spaced set screws 31. The guide 30 has an internal annular stop shoulder 32 and an internal annular locking recess 33 to receive latch lugs on the latch assembly of the service seal unit S. A top sub 34 is threaded on the upper end of the mandrel 25 and slidable within the setting sleeve 23. The top sub has an internal lug 35 for coupling the packer with the service seal unit. Holes 40 in the setting sleeve and 41 in the top sub are alignable for assembly purposes. The lower end edge 42 of the top sub is engageable by an internal annular stop shoulder 43 provided in the setting sleeve 23 to limit the upward movement of said sleeve relative to the mandrel. The mandrel has a plurality of circumferentially spaced ports 44 which open from the bore of the mandrel into an annular space 45 defined between the lower end portion of the setting sleeve and the mandrel.

The top slip assembly 20 as shown in FIG. 5B is mounted on the mandrel 25 at the lower end of the setting sleeve 23. The slip assembly includes a top slip carrier 50, a plurality of circumferentially spaced top slips coupled at upper ends into the carried and held around the mandrel 25 by a garter spring 52. The top slip carrier is secured within the lower end portion of the setting sleeve by set screws 53 which are screwed into the slip carrier and have outer end portions extending into slots 54 within an annular end cap 55 welded on the lower end of the setting sleeve. A plurality of internal slips 60 are positioned within a tapered recess defined within the upper end portion of the slip carrier 50 around the mandrel 25 and held within the tapered recess by a lock ring 61 secured within the upper end portion of the slip carrier around the mandrel. Referring to FIGS. 6A, 6B, and 6C, each of the slips 51 has an external lower tooth section 51*a*, a central reduced body section 51*b*, and an enlarged retainer head 51*c* which is provided with an internal arcuate flange 51*d*. As shown in FIG. 6D, the top slip carrier 50 consists of an upper annular ring portion 50*a* having circumferentially spaced screw holes 50*b* for the set screws 53. The slip carrier has four downwardly opening longitudinal slots 50*c* circumferentially spaced 90° apart dividing the major lower portions of the slip carrier into four arcuate cylindrical segments 50*d* each of which has an internal acruate recess 50*e*. The particular configurations of the top slips and slip carrier mesh together so that the slip carrier supports the slips on the mandrel spaced around the mandrel at 90° intervals. The body portion 51*b* of the slip fits within one of the slots 50*c* of the slip carrier while the opposite side portions of the slip head fit within the slip carrier recesses 50*e* on the opposite sides of the slip carrier slot 50*c*. Thus the heads of the slips are retained by the slip carrier while the tooth and body sections of the slips are free to pivot inwardly and outwardly for expanding and contracting the slips between lock and release positions. The garter spring 52 engages the slips at the junction of the body portion with the tooth section around the outer surfaces of the slips below the lower ends of the slip carrier sections 50*d*. The lower inside faces of the tooth sections of the top slips are slidable along a top slip expander wedge collet 62 shown in detail in FIGS. 6E and 6F. The collet 62 telescopes into and interlocks with an annular seal element retainer 63. A support ring 64 fits on the mandrel 25 within the upper end portion of the collet 62. As shown in FIGS. 6E and 6F the collet 62 includes a continuous annular base ring **62*a* and a plurality of circumferentially spaced collet fingers 62*b*. Each of the collet fingers has a tapered slip expander head 62*c*. A locking shoulder 62*d* is defined on each of the collet fingers for interlocking the collet with the element retainer 63. The support ring 64 fits between the collet finger heads 62*c* and the mandrel. The tooth sections of the slips 51 slide along the collet finger heads for expanding the slips when the slips are driven downwardly by the setting sleeve 23. The collet ring 62*a* and the finger portions 62*b* fit within the element retainer 63 while the lower end edges of the collet heads 62*c* are engageable with the upper end edge of the retainer 63. A snap ring 65 in an external annular recess of the mandrel 25 engages an internal annular flange 63*a* formed within the lower end portion of the element retainer 63** holding the element retainer against upward movement on the packer mandrel.

The seal assembly 22 includes a central annular seal element **22*a* and identical end seal elements 22*b*. The seal elements are conventional rubber or rubber-like reinforced material capable of withstanding the various liquids and gases encountered in a well bore. The end elements 22*b* are reinforced with an annular spring 22*c* which is embedded in the element at the free exposed end of the element to which expanding force is applied during the setting of the packer. The seal assembly is mounted on the mandrel 25 between the element retainer 63 at the upper end of the element and a lower slip mandrel 70 at the lower end of the seal assembly. The seal assembly 22** forms a fluid tight seal around the packer with the well bore wall such as along a string of well casing lining the well bore.

The lower seal assembly 21 includes the lower slip expander mandrel 70, a plurality of circumferentially positioned lower slips 71, a lower slip carrier 72, a tie bolt housing 73 and tie bolts 74 which extend longitudinally between the slips 71 slidably coupling the slip mandrel 70, the slip carrier 72, and the housing 73 together around the packer mandrel. The details of the construction of the lower slip mandrel 70 are shown in FIGS. 7A, 7B and 7C. The mandrel is an annular member sized to slide on the packer mandrel 25 and is provided with four circumferentially spaced dovetail shaped slip slots **70*a* for slidably coupling the slips with the mandrel. Between the slots 70*a* as shown in FIG. 7A, the mandrel has four circumferentially spaced screw holes 70*b* for the threaded ends of the tie bolts 74. The lower slips 71 are shown in detail in FIGS. 7D, 7E, and 7F. Each of the slips 71 has a tooth section 71*a* for gripping the casing wall surface, an internal dovetail shaped flanged section 71*b* as shown in FIG. 7E for engagement of each slip with the slip mandrel slots 70*a*, and bottom side recesses 71*c* as shown in FIG. 7F for coupling the slips with the slip carrier 72. The lower slip carrier 72 is an annular member as illustrated in FIGS. 7G and 7H provided with circumferentially spaced T-shaped end opening slots 72*a* for receiving the T-shaped ends of the slips 71 for coupling the slips with the slip carrier. It will be evident from FIGS. 7F and 7G that slip carrier flanges 72*b* at opposite sides of the slots 72*a* fit in the edge slots 71*c* of the slips for loosely coupling the lower ends of the slips with the slip carrier. The slip carrier has circumferentially spaced radial holes 72*c* used for connection of the slip carrier with the tie bolt housing 73. The slip carrier also has circumferentially spaced longitudinal holes 72*d* for the tie bolts 74. The slip carrier has an external annular recess 72*e* for an overlapping flange on the tie bolt housing. As evident from FIGS. 5B and 5BB, the tie bolt housing 73 is an annular member having an external annular end flange or skirt 73*a* provided with circumferentially spaced holes for lock pins 75 which connect the slip carrier 72 with the tie bolt housing. Also, the tie bolt housing has circumferentially spaced longitudinal bolt holes 73*b* which are graduated countersunk type holes for receiving the head ends of the tie bolts 74 as evident in FIG. 5BB. When the tie bolts are in position coupling together the previously identified components of the lower slip assembly 21, the tie bolt heads are engaged by a lock pin 80 inserted radially in the tie bolt housing intersecting the bolt hole 73*b* for holding the head ends of the tie bolts locked in position in the tie bolt housing. As also shown in FIG. 5BB the threaded ends of the tie bolts 74 engage the lower slip mandrel 70 and are locked against movement by a lock washer 81 and a nut 82 on the tie bolt threaded tightly against the end face of the slip expander 70. The bolt housing 73 of the lower slip assembly is threaded on an upper end portion of a tubular retainer sub 83 positioned around the packer mandrel 25 and secured to the mandrel by a pair of diametrically opposed shear screws 84 which function to disengage the packer mandrel from the retainer sub for retrieval of the packer from a set condition in a bore hole. The bore through the sub 83 is enlarged along the upper threaded end portion of the sub defining an internal annular stop shoulder 85 within the sub which is engageable with a snap ring 90 fitted in an external annular recess around the packer mandrel 25. Thus the downward movement of the mandrel relative to the sub is limited while the mandrel may move upwardly with the snap ring sliding along the enlarged bore portion of the sub during release of the packer. The sub has an internal annular lock and recess 91 which is engageable by external bosses on integral longitudinal locking fingers 92 formed in the packer mandrel 25** for releasably locking the mandrel with the sub.

The lower end portion of the sub 83 is threaded into a coupling 93 which is threaded on the upper end portion of a tubular pup joint 94. The pup joint 94 is threaded along the lower end portion into a tubular closing sleeve housing 95 provided with circumferentially spaced side ports 100 for flow laterally from the packer into a well bore such as when circulating various fluids through a well bore, depositing a gravel or slurry pack in the well bore, and the like. A cap 101 is secured on the lower end of the housing 95 for the connection of structure such as tubing below the packer. The housing 95 has an internal annular locking recess 102. A sleeve valve 103 is slidably disposed in the housing 95 for opening and closing the side ports 100. Longitudinally spaced ring seals 104 on the sleeve valve seal between the sleeve valve and the inner wall of the housing shutting off communication to side ports 100 when the sleeve valve is in the closed position illustrated in FIG. 5C. The sleeve valve has circumferentially spaced integral collet fingers 105 provided with heads **105*a* which are engageable in the housing locking recess 102 for releasably locking the sleeve valve closed as illustrated in FIG. 5C. The sleeve valve permits the side ports from the packer bore to be opened when the service seal unit is inserted into the packer and for the ports to be closed when the service seal unit is withdrawn from the packer. The lower end of the packer mandrel 25 extends into the pup joint 94. An open ended internally threaded cap 110 is secured on the threaded lower end portion of the packer mandrel 25 as shown in FIG. 5B**.

The service seal units S embodying features of the invention is illustrated in FIGS. 2, and 8A–9I inclusive. The service seal unit functions for both setting the packer P and properly directing fluid flow from a supporting tubing string to the packer side ports for such procedures as gravel and slurry packing. The unit S includes a cross-over valve assembly 120 for communication between the unit and the well bore at the upper end of the unit, a cylinder and piston assembly 121 for setting the packer, a latch assembly 122 for restraining the packer against premature setting, a J-latch 123 for releasably coupling the unit with the packer, a valve assembly 124 for selective communication with the packer for directing the flow of well processing fluids to the packer, and upper and lower seal assemblies 125 and 130 for sealing within the packer above and below the side ports of the valve assembly 124.

Referring to FIGS. 8A and 8B, the cross-over valve assembly 120 includes a top sub 131 threaded into the upper end portion of a tubular housing 132. Set screws 133 secure the top sub with the housing. A ring seal 134 seals between the top sub and the housing. The lower end of the housing is threaded into an operating lug assembly 135 which includes a body portion 140 having an internal lower end flange 140*a* and secured with the housing 132 by set screws 141. A rotating lug 142 is secured in the lower end portion of the body 140 and has an inward end portion extending inwardly of the flange 140*a*. A cross-over valve control lug 143 is secured within a rotatable sleeve 144 positioned within the body 140 between the lower end edge of the housing 132 and the upper end edge of the internal flange 140*a*. The lug 143 with the sleeve 144 is free to turn a full 360° within the body 140. The housing 132 has a plurality of side ports 145 to permit fluid flow between the bore of the unit S and a well bore around the unit. The outer housing assembly made up of the top sub 131, the housing 132, and the control lug assembly 135 is mounted for longitudinal telescoping movement on an inner housing assembly formed by a tubular end cap 150, a cross-over packing sub 151, and a J-slot mandrel 152. The packing sub 151 and the J-slot mandrel are mounted in concentric spaced relation on a tubular cross-over weld 153 which extends through the cylinder and piston assembly 121, the latch assembly 122, and the J-slot body 123. The packing mandrel 151 is provide with side ports 154 and supports identical seal assemblies 155 longitudinally spaced on either side of the port 154 providing a sliding seal between the housing 132 and the packing mandrel to prevent communication between the ports 154 in the packing mandrel and the ports 145 in the housing 132 when the ports are misaligned longitudinally. The concentric spacing between the packing mandrel 151 and the J-slot mandrel 152 on the outside and the cross-over weld 153 on the inside, defines the upper end portion of an annular flow passage 160 which runs the full length of the service seal unit extending from the lower end of the unit to the side ports 154 in the cross-over packing mandrel 151. Ring seals 161 around the upper end portion of the cross-over weld 153 seal between the weld and the packing sub 151 above the ports 154 closing the upper end of the annular space 160.

The cross-over valve 120 provides for fluid communication with the annulus bore of the service seal unit and is connected with supporting tubing such as the lower end of the tubing string 162, FIG. 2, threaded into the sub 131 so that rotation of the tubing string transmitted through the housing 132 turns the service seal unit for disconnection of the unit form the packer. The rotational and valving functions are obtained through the operating relationship between the operating lug assembly 135 and the J-slot mandrel 152. Further details of the mandrel 152 are shown in FIGS. 9A and 9B. The J-slot mandrel 152 is provided externally with a longitudinal straight downwardly opening slot 162 for engagement of the rotating lug 142 and a J-slot 163 for engagement of the valve control lug 143. The J-slot 163 is of a special configuration which permits sequential raising and lowering of the tubing string supporting the service seal unit to sequentially open and close the cross-over valve 120. The lug 142 moves longitudinally in the slot 162 as the housing 132 is raised and lowered for opening and closing the cross-over valve assembly and permits rotation of the housing 132 to apply a rotational force through the lug 142 to the J-slot mandrel 152 for turning the entire service seal unit in disconnecting the unit from the packer P. The control lug 143 with the internal sleeve 144 in which the lug is welded is free to turn relative to the rotationally fixed housing 132 and the body 140 so that as the housing and body are raised and lowered by the tubing string supporting the seal unit the lug 143 may seek the various valve open and valve closed positions in the J-slot 163 thereby limiting the upward and downward movement of the housing 132. The valving action of the valve assembly 120 is entirely dependent upon the relative longitudinal positions of the side ports 145 in the housing 132 and the side ports 154 in the cross-over mandrel 151. At the upper end position of the housing 132 at which the side ports 145 are aligned with the ports 154 the valve assembly is open inasmuch as the ports 145 are between the packing mandrel seals 155. At those lower positions of the housing 132 at which the side ports 145 are below the lower set of seals 155, the ports 145 and 154 are sufficiently misaligned that the valve assembly is closed. Referring to FIG. 9B which is a development in a single plane of the slots in the J-slot mandrel, understood in the mandrel to be wrapped around the mandrel, there are one upper open position and three lower closed positions to which the control lug 143 is guided as the tubing string raises and lowers the housing 132. An upper corner 163*a* of the slot defines the uppermost position to which the lug 143 may move. A lower intermediate corner of the slot 163*b* and an upper intermediate corner of the slot 163*c* define intermediate valve-closed positions to which the lug 143 moves. A lowermost corner 163*d* is also a closed valve-closed position to which the lug 143 moves. The sequence of operation of the cross-over valve assembly 120 responsive to raising and lowering the housing 132 by means of the tubing string 162 is as follows. Starting with the lowermost position of the housing tubing string with the lug 143 at the lowermost J-slot corner 163*d*, the tubing string is lifted raising the top sub 131, the housing 132, and the control lug assembly 140. The lug 143 moves straight upwardly along the J-slot straight edge 163*e* until the lug engages the upper sloping end edge 163*f* which directs the lug around the slot to the upper end corner 163*a*. When the lug 143 is at the upper corner 163a of the J-slot, the housing 132 is at the upper position at which the side ports 145 are aligned with the ports 154 so that the valve is open allowing communication from exterior of the valve into the annular flow passage 160. This would normally be the valve position used when circulation is desired through the service seal unit, the packer, and back to the surface through the annular space in the well bore around the supporting tubing string. For closing the valve the tubing string is then lowered so that the top sub 131 and the housing 132 move downwardly with the lug 143 moving along the side edge 163g of the J-slot until the lug reaches the lower intermediate end surface 163h which guides the lug to the lower intermediate corner 163b at which position of the lug the valve is closed. With the valve at this lower intermediate closed position fluids which are colder than the tubing string and other well equipment may be pumped downwardly in the tubing string for displacement out through the seal unit and the packer. Such colder fluids will cause the tubing string to shrink thereby lifting the sub 131 and the housing 132 so that the lug 143 moves upwardly from the lower intermediate corner 163b until it strikes the upper intermediate edge surface 163i which directs the lug to the upper intermediate corner 163c which locks the valve at the upper intermediate closed position so that the desired pumping may continue without returns flowing back upwardly through the service seal unit. When the pumping ceases and with no lifting force on the tubing string the top sub 131 and housing 132 are allowed to drop farther downwardly with the lug 143 striking the lower intermediate J-slot edge surface 163j which guides the lug into the lower straight portion of the J-slot the lower end corner 163d from which the sequence of operation is thereafter repeated with the raising and lowering of the tubing string. Thus it will be recognized that an initial raising of the tubing string from a lowermost position opens the cross-over valve assembly when the lug 143 moves to the corner 163a. Slacking off on the tubing string then closes the cross-over valve assembly as the lug 143 moves to the lower intermediate corner 163b. Again lifting the tubing string or when the tubing string shrinks during pumping down procedures the lug 143 moves to the upper intermediate corner position 163c with the cross-over valve still remaining closed. Again slacking off on the tubing string or the expansion of the tubing string due to a change of temperature moves the lug 143 back downwardly to the lowermost end position 163d at which the cross-over valve assembly is still fully closed. During these various up and down movements of the tubing string with the sub 131 and housing 132 the rotational movement of the sleeve 144 and the control lug 143 limits the upward and downward movement of the tubing string housing while the tubing string and housing are held against rotation by the lug 142 being restricted to vertical movement only in the straight vertical slot 162.

FIG. 8B shows the cylinder and piston assembly 121 along with the latch assembly 122 of the service seal unit. The lower end of the J-slot mandrel 152 is threaded into a tubular cylinder cap 170 threaded on an internal sleeve member 171. A ring seal 172 seals between the cylinder cap and the sleeve. Set screws 173 through the cylinder cap into the sleeve member lock the sleeve member and cap together. A cylinder head 174 is formed on and integral with the lower end of the cylinder cap. A cylinder 175 is secured along an upper end portion on the cylinder head by circumferentially spaced set screws 180. A ring seal 181 seals between the cylinder head 174 and the cylinder 175. A pair of spaced ring seals 182 seal between the cylinder head and the internal sleeve member 171. The sleeve member 171 forms a body mandrel through the piston-cylinder assembly 121 extending downwardly through the latch assembly 122 and the J-slot body 123. The mandrel member 171 extends in concentric spaced relation around the cross-over weld 153 defining the annular flow passage through the unit along the assemblies 121 and 122. The cylinder 175 is in concentric spaced relation around the mandrel member 171 defining an annular chamber 183 which communicates with the central bore of the service seal unit within the weld 153 through ports 185 which slope downwardly and inwardly from the cylinder 183 into the bore through the weld 153. As evident from FIGS. 8B and 8BB the mandrel member 171 and the weld 153 are secured together as by welding around the ports 185. The mandrel member 171 has side holes 190 which are slightly less in diameter than the diameter of a circular boss 191 on each side of the member 171 around the port 185 through the member. A weld is then made within the edge of each of the holes 190 at the boss 191 thereby securing the members 171 and 153 together at diametrically opposed locations as seen in FIG. 8BB. Thus fluid pumped downwardly through the bore of the weld 153 of the unit may pass outwardly through the ports 185 into the annular cylinder chamber 183 for setting the packer P. The downward sloping direction of the ports 185 is to minimize any tendency of gravel particles to flow into the chamber 183 during the placing of a gravel or slurry pack in a well bore.

An annular piston 192 is positioned to slide longitudinally within the chamber 183 between the cylinder 175 and the member 171. A ring seal 193 seals between the piston and the inner cylinder wall and ring seals 194 seal between the piston and the member 171. The piston is shaped and the ring seals are located so that fluid pressure applied through the ports 185 are applied to the piston over an annular area defined between the lines of sealing engagement of the outer ring seal 193 and the inner ring seals 194 to force the piston downwardly for setting the packer. The annular piston 192 is threaded on the upper end of a tubular piston extension 195 which is connected with the latch assembly 122 for releasably latching the piston extension to the packer setting sleeve coupling 30.

FIGS. 8B and 9C–9G illustrate details of the latch assembly 122 which couples the piston extension 195 with the setting sleeve 23 of the packer P. The piston extension 195 is enlarged along the lower end portion of the piston provided with a flange or skirt portion 195a which has an internal locking shoulder 195b. Above the skirt 195a the end portion of the piston extension has an external annular recess 195c at which the lower end portion of the piston extension is connected by shear pins 200 with the mandrel member 171. A setting sleeve 201 is releasably connected by shear pins 202 on the enlarged end portion of the piston extension 195. The end edge 201a of the setting sleeve 201 extends below the lower end edge of the retainer flange 195b on the piston extension when the setting sleeve 201 is shear pinned to the piston extension as shown in FIG. 8B. An annular locking collet 203 having a plurality of circumferentially spaced locking collet fingers 203a is positioned on the mandrel member 171. The mandrel member has an external annular stop shoulder 204 which is engageable by an internal annular stop shoulder 203b within the collet limiting the upward movement of the collet on the mandrel member 171. The collet fingers 203a have locking heads 203c which are engageable in an external annular locking recess 171a provided around the mandrel member 171 when the latch assembly 122 is in the locked condition as illustrated in FIG. 8B. At such position the end locking flange 195b at the lower end of the piston extension 195 holds the collet heads 203c inwardly in the locking recess 171a so that the collet 203 is not free to move downwardly on the mandrel member 171. As best seen in FIGS. 9C, 9D and 9E the collet 203 has circumferentially spaced laterally extending slots 203d in each of which is disposed a radially movable latch lug 205 which engages the internal locking recess 33 in the coupling 30 on the packer setting sleeve 23 to prevent accidental movement of the packer setting sleeve. The details of the construction of the latch lugs 205 are shown in FIGS. 9F, 9G, and 9H. Each of the lugs 205 has a central upwardly opening slot 205a through which a retainer pin 210 extends to hold the latch lugs in the slots 203d of the collet. The retainer pins 210 each extend through longitudinal holes 203e in the collet, each of the holes intersecting the midpoint of the lateral latch lug slots 203d. A spring 211 is fitted within each of the latch lug recesses 205a beneath the pin 210 bearing against the bottom of the latch lug slot so that each of the latch lug springs is compressed between the pin 210 at the upper end and the bottom of the latch lug slot at the lower end whereby the spring biases the latch lugs radially inwardly. Thus when the collet 203 moves downwardly on the mandrel 171 to a position at which the flared lower ends of the latch lugs 205 are below the shoulder 204 on the mandrel, the springs 211 retract the latch lugs inwardly farther into the collet slots which are latch lug release positions freeing the packer setting sleeve. Primarily the latch assembly 122 functions to preclude premature accidental setting of the packer.

The tubular mandrel member 171 extends through the J-slot body 123 which is threaded on the mandrel as seen in FIG. 8C. Set screws 211 are threaded through the body into the mandrel 171 to prevent the body from unscrewing from the mandrel. The J-latch body 123 is employed to couple the service seal unit S with the packer P.

The J-latch body 123 as shown in FIG. 8C has a J-slot 123a for receiving the packer lug 35. The J-slot 123a is shown in detail in FIG. 9I. It will be recognized that the J-slot extends circumferentially around the body 123 and has been developed in a single plane in FIG. 9I for a better understanding of the configuration of the J-slot. The J-slot 123a has a locking portion defined by an upper corner 123b, a lower corner 123c, and a connecting straight edge portion 123d. A release portion of the J-slot includes a straight portion 123e and an outwardly flared exit portion 123f. The exit portion is connected with the lock portion by a central convergent section defined by converging upper and lower edge surfaces 123g and 123h. When the packer P and the service seal unit S are assembled together at the surface for running and setting the packer, the packer lug 35 is positioned in the lock portion of the J-slot 123a in which the packer lug remains so long as the service seal unit is not rotated clockwise. So long as the service seal unit is only raised or lowered along a straight line, the packer lug will remain within the lock portion of the J-slot and may move along the straight edge surface 123d between the upper and lower lock corners 123b and 123c. Of course, initially the packer is latched to the service seal unit but is disconnected after the packer is set so the service seal unit may be removed. Clockwise rotation of the service seal unit as viewed from the surface end of a well bore rotates the unit with the J-slot housing 123 in a clockwise direction so that the relative opposite direction motion of the J-slot 123a and the packer lug 35 directs the packer lug along the central portion of the J-slot against either of the sloping edge surfaces 123g or 123h depending upon the particular vertical location of the packer lug at the time of rotation guiding the packer lug into the straight exit portion of the J-slot. When the packer lug moves into the exit portion in the straight section 123e an upward pull on the service seal unit lifts the unit so that the relative motion between the packer lug and the J-slot causes the packer lug to pass downwardly and out from the J-slot along the flared exit portion 123f of the J-slot fully releasing the service seal unit from the packer. Similarly when inserting the service seal unit into the packer the packer lug 35 enters the J-slot portion 123f which now functions as an entry portion guiding the packer lug upwardly along the section 123e into engagement with the central J-slot surface 123g which directs the packer lug toward the locking corner 123b of the J-slot for coupling the service seal unit with the packer.

The valve assembly 124 through which fluid may be discharged from the central bore of the service seal unit is supported from the lower end of the mandrel 171 by a tubular member 212 and a tubular member 213. The member 212 is threaded along an upper end portion along the lower end portion of the mandrel 171. The tubular member 213 is threaded along an upper end portion on the lower end portion of the member 212. A packing assembly 125 is supported on the member 212 for sealing around the member within the bore of the packer P above the lower packer side ports 100. The tubular member 153 extends within the member 212 and is provided with an enlarged lower end portion which telescopes over and is sealed with a tubular member 215 extending downwardly in concentric spaced relation within the members 212 and 213 providing a continuation through this portion of the service seal unit of the annular flow passage 160. The valve assembly 124 supported from the lower end of the tubular member 213 includes a tubular housing 220 threaded along an upper end portion into the lower end of the member 213 and threaded along a lower end portion on the upper end of a tubular member or packing mandrel 221. The lower packing assembly 130 is supported along a lower end portion of the member 221 for sealing around the service seal unit below the packer side port 100. The valve housing 220 has side ports 222 for flow of fluids between the service seal unit and the packer side ports 100. The housing 220 is secured in concentric spaced relation around an inner tubular member 223 which serves multiple structural functions including serving as a valve seal retainer. The member 223 is provided with circumferentially spaced side ports 224 which register with the housing side ports 222. As seen in FIGS. 8D and 8DD the member 223 has an external integral flange around each of the side ports 222 which is welded with the housing member 220 along the edges of the ports 222 of the housing member providing a flow spider configuration as evident in FIG. 8DD which permits separate radial and longitudinal annular flow along the unit at the side ports 222. The tubular member 223 is supported in internal concentric spaced relation within the member 213 and the housing 220 and has an enlarged upper end portion which is telescoped over and sealed with the lower end portion of the member 215 thereby defining the annular flow passage along the unit within the valve assembly 124. The annular flow passage 160 extends through the spider configuration of FIG. 8DD with the annular flow provided for along the member 223 around the flange portions of the member which encircle the ports 224 so that flow may occur around the side ports continuing upwardly along the unit above the side ports without communication with the radial flow through the side ports. A tubular member 225 closed at a lower end 225*a* is threaded on the lower end of the member 223 closing the lower end of the central flow passage through the unit and serving as a valve seat retainer. A tubular valve seat 230 is slidably positioned within the members 223 and 225 releasably secured by circumferentially spaced shear pins 231 extending between the lower end portion of the valve seat and the lower end portion of the member 223. The upper end of the valve seat 230 is enlarged and carries a seal 232 which seals with the bore wall of the member 223 above the side parts 224 in the member 223 when the seat 230 is pinned at the position illustrated in FIG. 8D. The seat 230 has a downwardly sloping internal annular seat surface 233 shaped to receive a ball valve 234 illustrated in FIG. 8D which is dropped into the unit when closure of the valve assembly 124 is desired to increase pressure in the service seal unit for pressuring the piston assembly to set the packer P. The tubular member 223 and the valve seat 230 have graduated diameters providing an external annular stop shoulder 230*a* on the valve seat 230 and an internal annular stop shoulder 223*a* in the member 223 so that when the pins 231 are sheared releasing the seat 230, the seat is moved downwardly until the seat shoulder 230*a* engages the tubular member shoulder 223*a*. The seat 230 has side ports 230*b* below the seat 233 for flow from the base of the unit to the side ports 224 when the base is not closed by the ball 234.

A retainer ring or cap 240 is threaded on a lower end portion of the tubular member 221 holding the seal assembly 130 on the member. The member 221 is reduced and externally threaded along the lower end portion 221*a* for connection of additional tools on the lower end of the service seal unit if desired. The member 221 has a reduced bore portion 221*b* opening through the lower end of the unit. The members 225 and 221 are in concentric spaced relation defining the continuation between the members of the annular flow passage 160 which opens into the bore 221*b* so that there is flow communication from below the lower end of the service seal unit into the annular flow passage 160.

In carrying out well operations such as gravel and slurry packing using the service seal unit of the invention, the packer P is equipped with a suitable standard gravel or slurry pack screen 240 as represented schematically in FIG. 3 and shown and further described at pages 3936–3937 of the 1974–75 edition of *The Composite Catalog of Oilfield Equipment and Services*, published by World Oil, Houston, Tex. The screen 240 is supported from the lower end cap 101 on the packer. The service seal unit S is telescoped into and coupled with the packer in the relationship illustrated in FIGS. 10A, 10B, 10C, 10D, and 10E. As the service seal unit is inserted into the packer the J-slot body 123 engages the packer lug 35 with the packer lug moving into the J-slot 123*a* through the flared open end portion 123*f* passing upwardly in the straight portion 123*e* until the packer lug engages the surface 123*g* which cams the unit rotationally until the packer lug enters the locking section of the J-slot extending between the upper and lower end corners 123*b* and 123*c*. The lower end portion of the service seal unit including the valve assembly 124 telescopes into the lower end of the packer shown in FIG. 10E where the lower end of the member 221 of the seal unit moves into the sleeve valve 103 until the tapered lower end edge of the retainer 240 engages the internal annular shoulder surface 103*a* of the sleeve valve pushing the sleeve valve downwardly. The collet fingers 105 on the sleeve valve are cammed inwardly releasing the collet fingers from the locking recess 102 of the sleeve valve housing 95 and the sleeve valve is carried downwardly opening the side ports 100 with the collet finger heads 105*a* being cammed inwardly around the tubular member 221 on the service seal unit above the shoulder 221*c* so that when the service seal unit is retrieved the sleeve valve will be pulled back to the closed position. The sealing relationship between the sleeve valve 103 and the housing 95 and the seal assembly 130 with the bore of the sleeve valve 103 prevents any fluid communication upwardly within the housing 95 to the side ports 100.

Figure 10A:
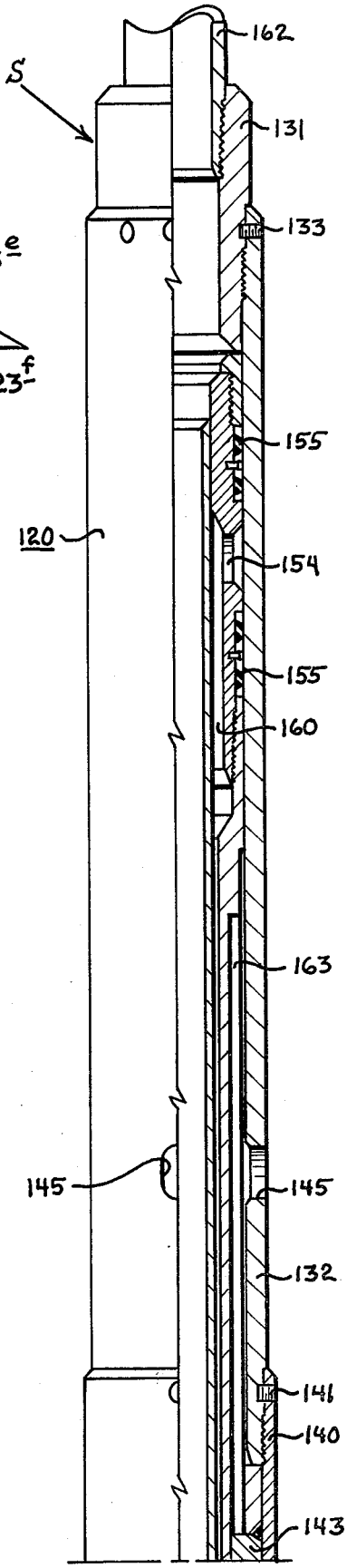
Figure 10B:
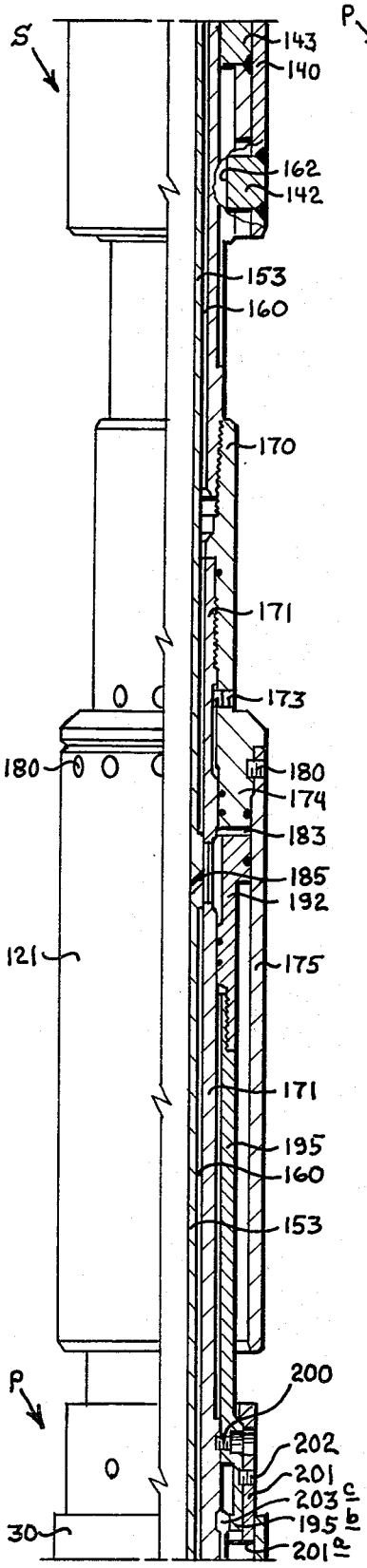
Figure 10C:
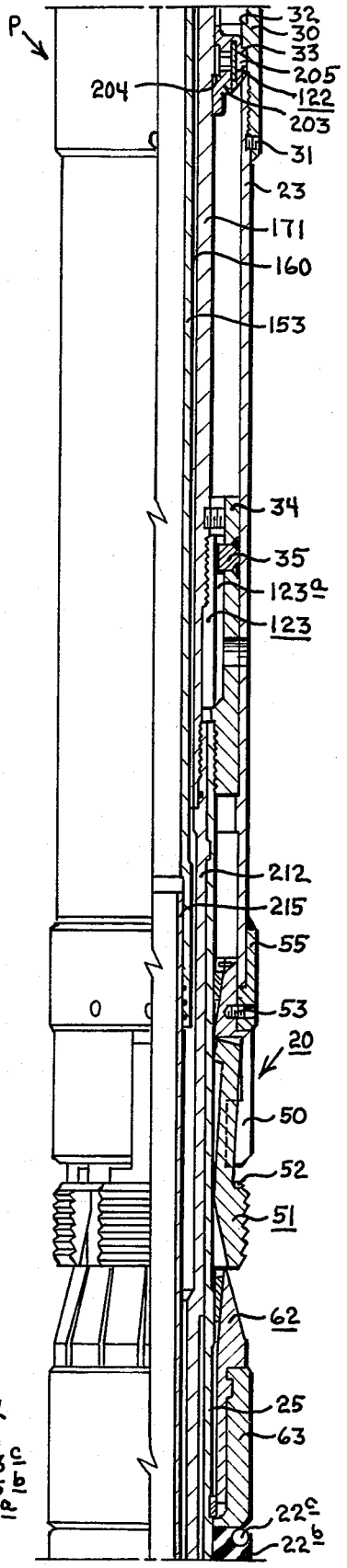
Figure 10D:
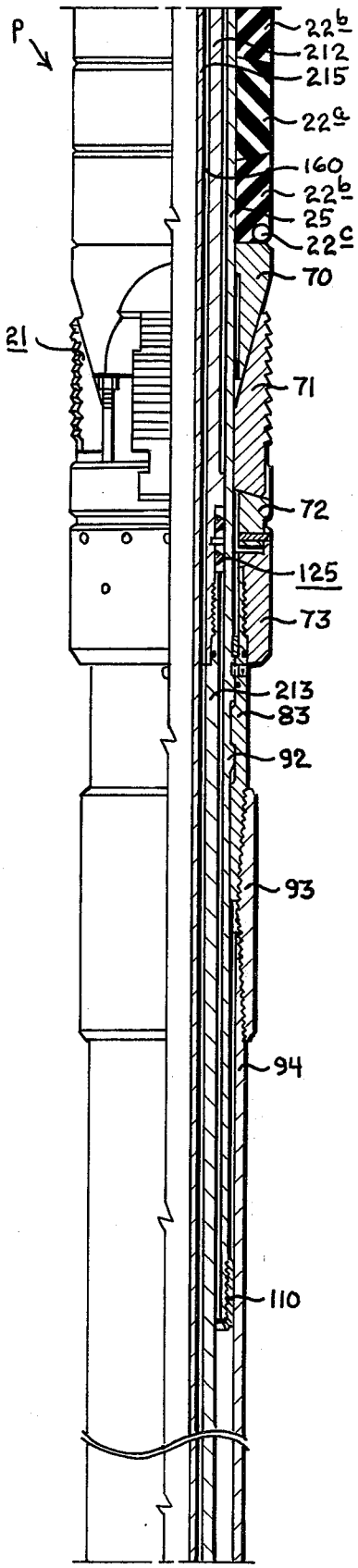

In assemblying the service seal unit S with the packer P it is necessary to couple the latch assembly 122 with the upper end coupling 30 on the packer. This is accomplished by disengaging the coupling 30 from the packer and placing the coupling on the service seal unit during assembly of the seal unit. This is done by assemblying the collet 203 with the associated parts including the spring loaded latch lugs 205 on the mandrel member 171 with the collet and latch lugs positioned sufficiently below the shoulder 204 for the latch lugs to be retracted inwardly by the springs 211 so that the coupling 30 is then placed over the collet and latch lugs with the latch lugs being aligned in the locking recess 33 of the coupling 30. The collet is then moved toward the shoulder 204 until the collet heads 203*c* are engaged in the external annular locking recess 171*a* of the mandrel 171 and the latch lugs 205 are propped outwardly by the mandrel surface above the shoulder 204 to the locking positions represented in FIGS. 8B and 10C. The remainder of the service seal unit is then assembled above the latch assembly 122 with the piston extension 195 being shear pinned to the mandrel 171 and the setting sleeve 201 being shear pinned to the piston extension as illustrated in FIG. 10B. Thereafter in assemblying the packer on the service seal unit the coupling 30 is rotated to thread the coupling on the upper end of the setting sleeve 23 of the packer. Thus the service seal unit is coupled with the packer by both the engagement of the lug 35 in the J-latch body 123, and the connection of the latch assembly 122 with the packer coupling 30. The assembled packer and service seal unit are then supported from a tubing string 162 which is connected into the top sub 131 at the upper end of the service seal unit. The packer and service seal unit are then lowered in the well bore to the depth at which the packer is to be set and the gravel or slurry pack to be deposited around the screen 240 in the bore hole. It will be understood that at this stage in the well procedure the ball valve 234 is not in place within the service seal unit. Thus, as the packer supported on the service seal unit is lowered in the relationship represented in FIGS. 10A–10E any fluid in the well bore may flow laterally into the central bore of the service seal unit at the valve assembly 124 through the side ports 222 and 224 of the housing 220 and the tubular member 223. The flow then passes through the ports 230*b* in the seat member 230 to the central bore of the service seal unit through which the flow may pass upwardly through the unit into the supporting tubing string 162. During the lowering of the packer and service seal unit the valve assembly 120 at the upper end of the service seal unit may be either open or closed by manipulation of the tubing string to position the lug 143 in the J-slot 163 as desired. The weight of the major portion of the service seal unit and all of the packer is on the J-slot mandrel 152 while the housing 132 and top sub 131 are coupled with the tubing string 162 so that gravity tends to telescope the valve assembly 120 to the extended open position. It will be recognized from the configuration of the J-slot 163 that the valve will either be fully extended in the full open position at which the lug 143 is in the upper corner 163*a*, or the valve will be in the intermediate closed-lock position at which the lug 143 is in the J-slot corner 163*c*. If open the ports 145 and 154 of the valve assembly 120 are aligned communicating the annular flow passage along the service seal unit with the casing annulus of the well around the tubing string. As previously described, the annular flow passage 160 in the service seal unit extends the entire length of the unit opening through the bottom of the unit around the lower end of the member 225 and continuing upwardly throughout the length of the service seal unit to the side ports 154. The annular space thus extends around the member 225, the member 223, through the flow spider configuration at the ports 224, along the member 215, and along the member 153 past the flow spider arrangement at the ports 185 to the side ports 154. Of course, if the valve assembly 120 is closed the side ports 145 and 155 are misaligned as shown in FIG. 8A with no communication through the valve assembly 120 back into the well annulus at the upper end of the service seal unit. Generally, where a gravel pack is to be deposited in the well bore fluids will have been circulated out of the well so that the service seal unit will probably be lowered with the valve assembly 120 closed.

Figure 10E:
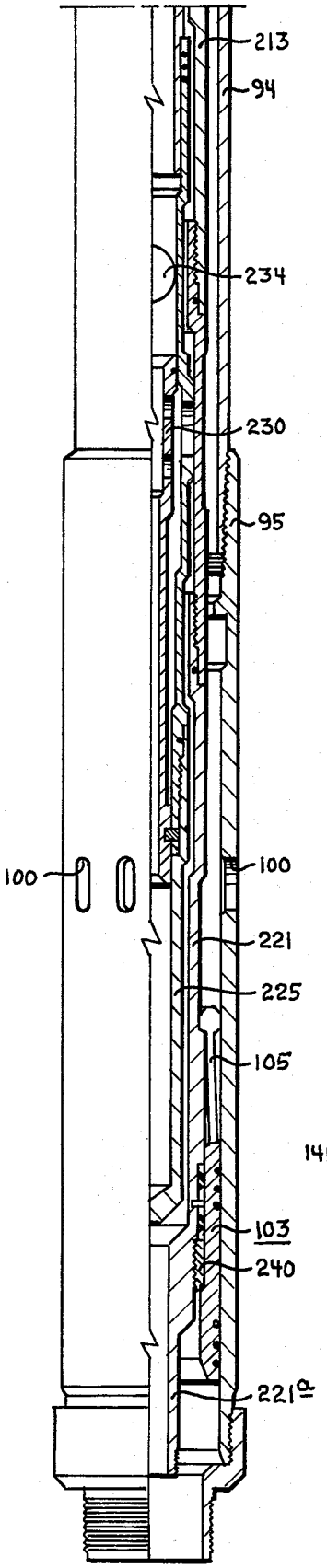
Figure 11A:
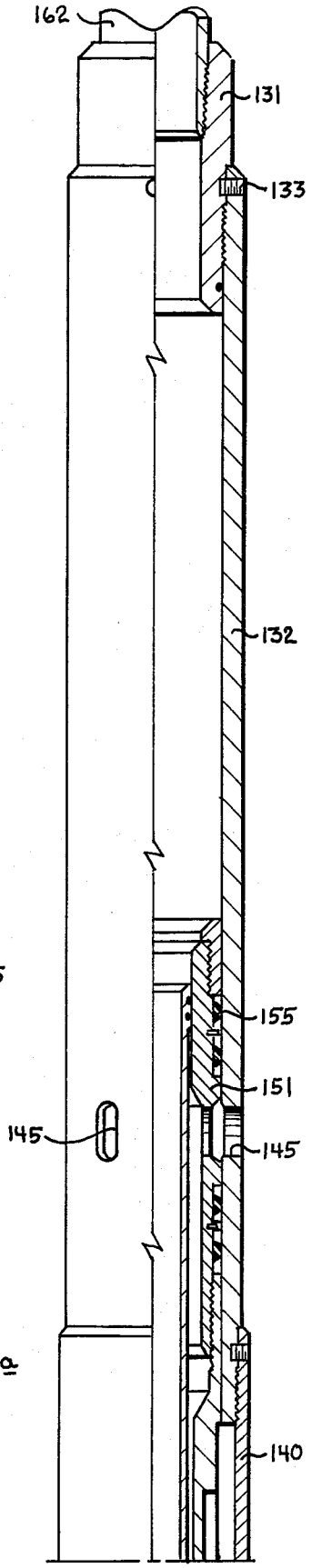
Figure 11B:
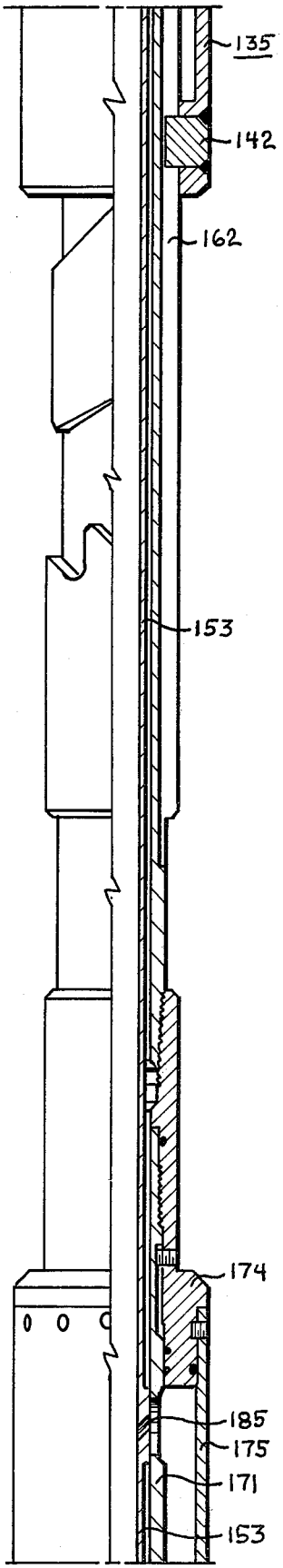
Figure 11C:
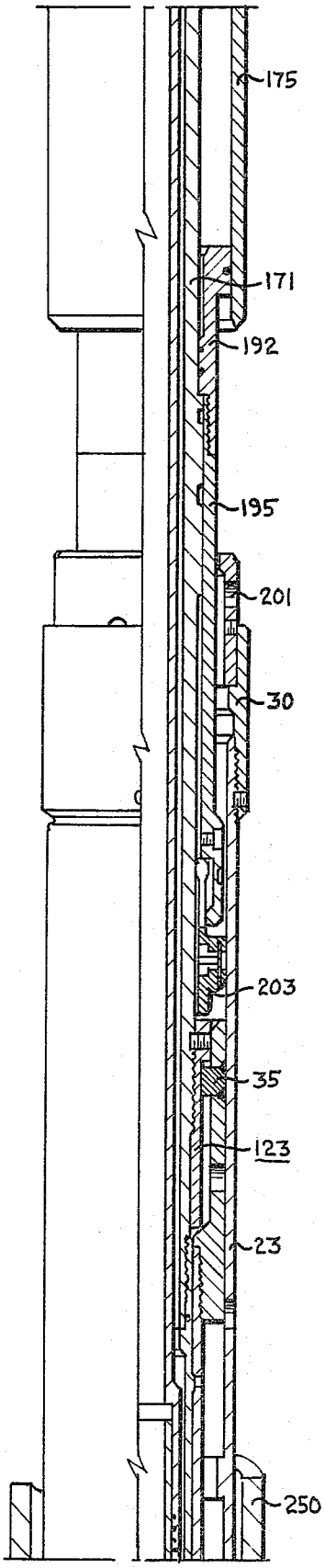

When the packer and service seal unit have been lowered on the tubing string to the depth at which the packer is to be set, the ball valve 234 is dropped from the surface through the tubing string 162 into the bore of the service seal unit where the ball comes to rest on the ball seat 233. The fluid pressure in the tubing string applied to the bore of the service seal unit is raised to a predetermined level such for example as 1000 psi which pressure is applied through the side ports 185 of the member 153 into the annular cylinder chamber 183. At the initiation of this packer setting fluid pressure the parts of the packer and the service seal unit are relatively positioned as represented in FIGS. 10A–10E. With the ball valve 234 on the seat 233 the only direction in which the increased fluid pressure can be applied external of the bore through the service seal unit is through the ports 185. This packer setting pressure is therefore exerted on the annular piston 192 over an annular area defined by the ring seal 193 on the outside and the ring seal 194 on the inside. The downward force on the annular piston is exerted through the piston extension 195 to the lower end of the piston extension which is restrained against movement by the shear pins 200 engaging the lower end of the piston extension and extending into the member 171. When the force is sufficient to shear the pins 200 such for example as the previously indicated 1000 psi, the pins 200 shear releasing the piston extension and piston for downward movement. As the piston and piston extension start moving downwardly the piston extension setting sleeve 201 connected to the piston extension by the shear pins 202 also moves downwardly. When the locking shoulder 195*b* within the lower end of the piston extension moves beyond the collet heads 203*c* the collet heads are free to expand outwardly into the enlarged lower end of the piston extension out of the locking recess 171*a* which will begin to occur when the end edge 201*a* of the setting sleeve 201 engages the internal annular stop shoulder 32 within the packer coupling 30 at which time the flange 195*b* within the piston extension end is substantially past the collet heads 203*c*. When the setting sleeve 201 on the piston extension engages the shoulder 32 of the packer coupling the collet heads 203*c* spring outwardly from the locking recess 171*a* because the force of the setting sleeve transmitted through the coupling 30 is communicated to the latch lugs 205 which are engaged in the locking recess 33 of the coupling 30. The force on the latch lugs 205 tends to move the collet 203 applying a pulling force through the collet fingers 203*a* to the collet heads 203*c*. As soon as the collet heads 203*c* spring outwardly within the enlarged end of the piston extension the packer setting sleeve 23 is driven by the packer coupling 30 which is being forced downwardly by the piston extension setting sleeve 201. The collet 203 and the latch lugs 205 are carried along with the setting sleeve because of the engagement of the latch lugs in the sleeve recess 33. As soon as the base ends of the latch lugs pass the shoulder 204 the springs 211 of the latch lugs retracts each latch lug inwardly out of the recess 33 of the coupling 30. When the force of the piston is applied through the setting sleeve 201 to the packer coupling 30 driving the packer setting sleeve 23 downwardly, the upper ends of the slips 51 are engaged by the slip carrier 50 forcing the slips downwardly against the upper slip collet wedge 62 causing the slips to move outwardly toward the casing 250 in the well bore. When the slips 51 have moved outwardly along the collet wedge into engagement with the inner wall of the casing, the slips drag along the casing forcing the collet wedge downwardly driving the upper seal element retainer 63 downwardly against the seal assembly 22. The force applied to the seal assembly 22 is transmitted to the lower slip mandrel 70 driving the lower slip mandrel downwardly so that the sloping surfaces 77*a* along the lower slip mandrel tend to slide along the inner faces of the lower slips 71. While the setting piston of the service seal unit moves downwardly the mandrel member 171 of the unit is held against downward movement through the connection upwardly into the supporting tubing string 162 and thus the J-latch body 123 is held against downward movement. The connection of the J-latch body 123 with the lug 35 of the packer prevents the packer mandrel 25 from moving downwardly thereby holding the lower slips 71 from downward movement by virtue of the connection of the packer mandrel 25 with the members 83 and 73 through the shear pins 84. The member 73 holds the lower slip carrier 72 from moving downwardly thereby preventing downward movement of the lower slips 71 so that the lower slips must expand outwardly against the casing wall. The sequential downward movement of the various parts of the packer seal assembly 22 and the upper and lower slip assemblies first fully sets the lower slips, then compresses the seal assembly 22 until it is expanded into sealing engagement with the casing wall, and thereafter fully sets the upper slips with the entire slip setting and seal assembly expansion being accomplished by the downward force only of the setting sleeve 23. When the fluid pressure being applied to the piston 192 reaches the level required to fully set the packer, which may, for example, be on the order of about 2500 psi, the pins 202 shear releasing the piston extension 195 from the piston setting sleeve 201 thereby rendering the setting sleeve inoperable. With the upper and lower slips fully set and the packer seal assembly 22 expanded the internal slips 60 prevent the upper slip carrier 50 and the upper slips 51 from moving upwardly as the inner slips 60 grip the outer surface of the packer mandrel 25. The gripping effect of the upper and lower slips holds the packer against the pressure differential in either direction across the seal assembly. FIG. 11C illustrates the complete release of the piston extension from the piston setting sleeve 201 pushing the packer setting sleeve latch assembly 122 ahead of the end of the piston extension to a fully released position from the packer coupling 30. The internal annular shoulder 192*a* within the annular piston 192 engages the external annular shoulder 171*b* on the mandrel 171 limiting the movement of the piston and the piston extension to the position shown in FIG. 11C after the pins 202 have sheared rendering the packer setting sleeve 23 inoperative.

Figure 11D:
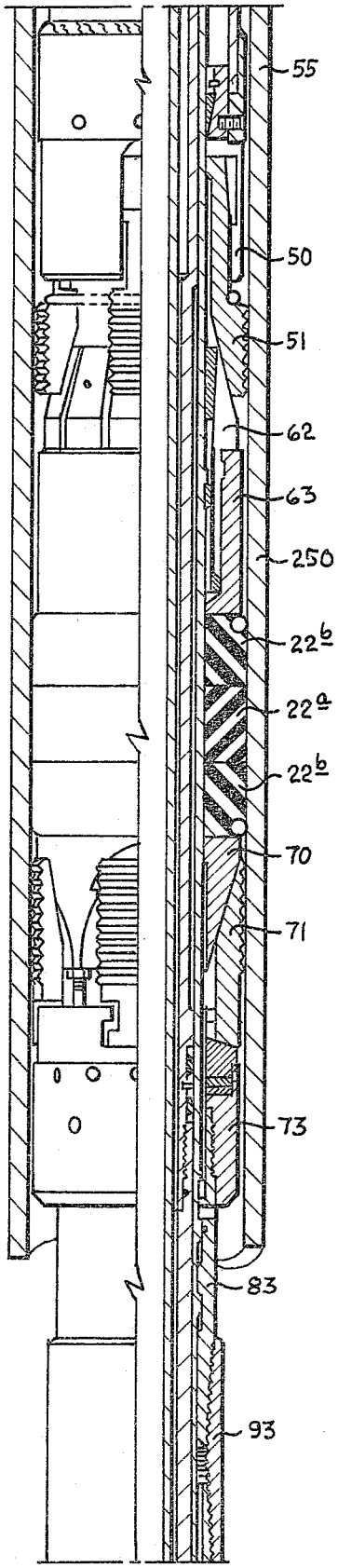
Figure 11E:
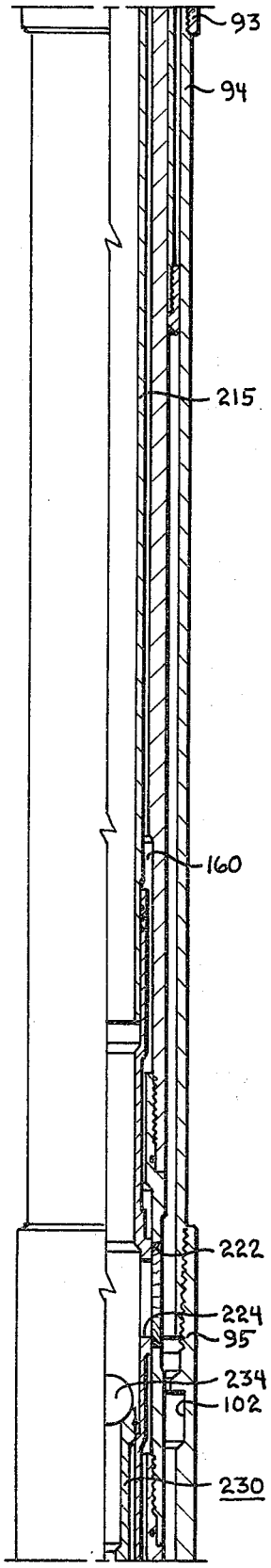

During the manipulation of the packer and the service seal unit while lowering the packer and seal unit to the proper death and preparing the packer for setting at such depth, the latch assembly 122 on the service seal unit prevents premature accidental setting of the packer due to the engagement of the latch lugs 205 with the packer coupling 30. The lugs 205 restrain the packer setting sleeve 23 from downward movement and the latch assembly 122 is fully protected against accidental release because all of the parts of the assembly are interior of the packer setting sleeve 23 and the coupling 30 so that as the tools move along the casing wall of the well none of the parts of the latch assembly contact any of the casing wall. The latch assembly cannot be released to free the packer setting sleeve until the pins 200 are sheared. The pins 200 also are fully protected against accidental shearing due to the positions of the pins inward of both the piston setting sleeve 201 and the end portion of the piston extension 195. The limited movement of the piston and piston extension also precludes any force on the J-slot and lug coupling between the service seal unit and the packer as also shown in FIG. 11C. FIG. 11D illustrates the packer upper and lower slip assemblies fully set and the seal assembly expanded.

After the packer has been set as described and the packer setting sleeve rendered inoperable, the fluid pressure transmitted to the service seal unit through the tubing string 162 may be further increased for purposes of opening the service seal unit to the packer to carry out the gravel pack or slurry pack procedure through the valve assembly 124 at the lower end of the service seal unit and the packer side ports 100. The shear pins 231 holding the seat member 230 in the member 223 as shown in FIGS. 8D and 10E may, for example, be sized to shear at 3500 psi thereby insuring that the packer is fully set before the service seal unit is opened to the well bore below the packer seal element assembly. Such an arrangement increases the assurance of packer setting before the succeeding well procedures are attempted. The force of the increased pressure over the upper end of the seat member 230 which is closed by the ball valve 234 forces the seat member downwardly after the pins 231 shear until the enlarged head end of the seat member engages an internal annular stop shoulder 223*a* within the member 223 at which position the side ports 224 are open for flow from the service seal unit bore laterally outwardly into the packer bore through which flow may occur to the packer side ports 100 into the well bore. Control of return flow through the annular space 160 along the service seal unit around and separate from the central bore through the seal unit and outwardly through the side ports 145 at the upper end of the seal unit is controlled by raising and lowering the tubing string 162. The system may be tested to determine if the seal assembly 120 at the upper end of the service seal unit is open or closed by pumping fluid down the casing with the blowout preventers at the surface closed. If the well circulates, the valve assembly is open. If there is no circulation the valve assembly is closed. In performing a gravel pack in the well bore below the expanded seal assembly 22, the tubing string 162 is lifted opening the valve assembly 120 as previously described and gravel is pumped in a carrier fluid downwardly and outwardly through the packer side ports to fill the annular space within the well bore casing around the screen 240 until the pressure indicates that the gravel has reached a predetermined fill-up by covering the gravel screen. As previously discussed, any fluid returns may pass upwardly through the open lower end of the service seal unit and upwardly through the annular space 160 in the unit and thereafter outwardly through the side ports 145 into the well bore annulus above the packer seal element around the tubing string 162. Where it is desired to pump fluid into the formation below the packer seal element and thus no return flow is desired, the tubing string 162 is lowered closing the valve assembly 120 of the sevice seal unit. In pumping down the tubing string temperatures which cause the string to shrink may lift the sub 131 and the housing 132 at the upper end of the seal unit shifting the lug 143 to the intermediate lock-close position where the lug is trapped in the J-slot corner 163*c* as shown in FIG. 9B. FIG. 3 represents schematically the pumping of fluids as in gravel packing downwardly and outwardly through the packer into the well bore around the screen 240 within the well casing.

Figure 11F:
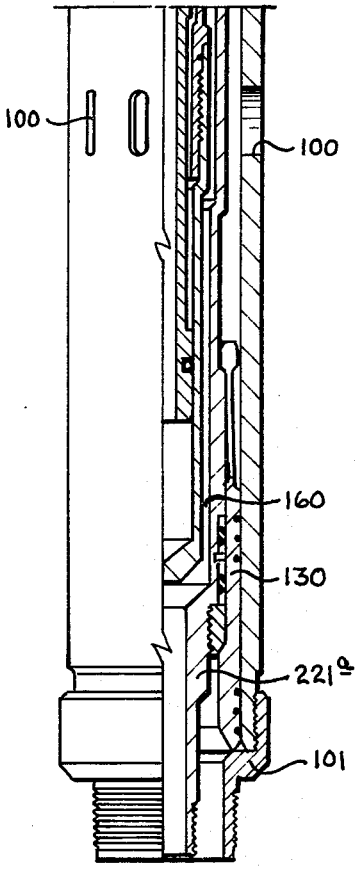

After completion of the well treatment procedure such as the gravel packing the service seal unit S is removed from the well packer by rotating the unit by means of the tubing string 162 one third of a turn clockwise which disengages the J-slot 123*a* of the J-slot body 123 from the packer lug 35. The service seal unit is then lifted straight upwardly by the tubing string. As the seal unit is lifted the shoulder 221*c* on the member 221 at the lower end of the seal unit as seen in FIG. 11F, pulls the collet heads 105 on the sleeve valve 103 upwardly until the collet heads reach the recess 102 in the housing 95 at which point the collet heads spring outwardly releasing from the shoulder 221*c* leaving the sleeve 103 closing the packer side ports 100. The service seal unit is then fully withdrawn from the packer and returned to the surface by the tubing string 162. A production tubing string may then be connected into the packer as represented schematically in FIG. 4 and shown in greater detail at page 3937 of *The Composite Catalog of Oilfield Equipment and Services,* supra, for production of well fluids from the well through the gravel or slurry pack. A particular advantage of a well so treated is that in the case of well fluids which carry substantial quantities of sand the gravel or slurry pack serve to filter out the sand before the flow up the production tubing.

When desired the packer may be retrieved to the surface by using standard tools and procedures for grasping the coupling 30 at the upper end of the packer applying an upward force to the setting sleeve which transmits such force through the member 34 to the packer mandrel 25. When the force is sufficient to shear the screws 84 the mandrel is released for upward movement relative to the slip and seal assemblies unseating the slips and allowing the seal assembly to retract from the casing wall. The packer may then be lifted to the surface.

It will now be seen that a new and improved service and setting seal unit for use in hydraulically setting well packers for such well procedures as gravel packing and the like has been described and illustrated. The service and seal unit include structure which couples with the packer to prevent premature setting of the packer due to obstructions along the bore hole as the packer is lowered. The protective devices against premature packer setting are positioned internally of the packer and service seal unit. The complete hydraulic mechanism for setting the packer is included in the service seal unit and is thereby retrieved to the surface leaving only the packer and the well bore.

What is claimed is:

1. A service seal unit for hydraulically setting a well packer in a well bore and directing fluid flow through said packer into said well bore comprising: a body mandrel provided with first and second separate longitudinal flow passages for fluid circulation through said seal unit to and from said well bore below said packer; valve means on said body mandrel for communicating one of said flow passages with said well bore around said unit above said packer; valve means on said body mandrel for communicating the other of said flow passages with ports in said packer leading to said well bore below said packer; hydraulic means comprising an annular cylinder and piston assembly on said body mandrel for operating a setting sleeve of said well packer; a setting sleeve releasably connected on said annular piston engageable wih said setting sleeve of said packer for setting said packer; latch means on said body mandrel including radially movable lugs for engaging said packer setting sleeve internally for restraining said setting sleeve against premature setting while said packer is manipulated to a desired location for setting in said well bore and releasable from said packer setting sleeve upon movement of said annular piston toward said packer setting sleeve; and coupling means on said body mandrel for releasably coupling said unit with the body mandrel of said packer while said hydraulic means operates said setting sleeve of said packer.

2. A service seal unit for hydraulically setting a well packer in a well bore and circulating fluid between separate flow passages above said well packer and said well bore below said well packer comprising: a body mandrel provided with separate longitudinal central and annular flow passages; a first valve assembly on said body mandrel for directing fluid flow between said annular flow passage above said packer and the exterior of said unit in said well bore; a second valve assembly on said body mandrel for directing fluid flow between said central flow passage and the exterior of said unit in said well bore below said packer; an annular cylinder on said body mandrel in fluid communication with said central flow passage; an annular piston in said cylinder; packer setting sleeve operating means connected with said piston for engaging and operating a setting sleeve on said well packer; a releasable latch assembly on said body mandrel for engaging said packer setting sleeve internally and restraining said packer setting sleeve from premature setting while manipulating said well packer with said service seal unit to a desired location in said well bore and for disengaging from said packer setting sleeve responsive to operation of said packer setting sleeve; a setting sleeve releasably connected with said annular piston for engaging said packer setting sleeve responsive to movement of said piston and disengaging said piston when said packer setting sleeve is operated to set said packer; means connected with said annular piston holding said latch assembly operably connected with said packer setting sleeve until said annular piston is operated to set said packer; and means for releasably coupling said body mandrel of said service seal unit with the body mandrel of said packer to hold said packer during operation of said packer setting sleeve operating means.

3. A service seal unit in accordance with claim 2 wherein said latch assembly includes a plurality of radially movable lugs for engaging a locking recess in said packer setting sleeve.

4. A service seal unit for hydraulically setting a well packer in a well bore and directing fluid communication between separate flow passages above said packer and said well bore below said packer through side ports in said packer comprising: a body mandrel provided with separate longitudinal central and annular flow passages including upper side ports leading to the upper end of said annular flow passage, said annular flow passage opening at a lower end through the lower end of said body mandrel, and side ports leading to the lower end of said central flow passage; longitudinally spaced seal means on said body mandrel above and below said lower side ports for sealing between said body mandrel and the central bore of said well packer above and below said side ports in said packer; a longitudinally operable valve assembly on said body mandrel for controlling flow through said upper side ports responsive to raising and lowering a tubing string extending to said unit in said well bore; a second valve assembly in said body mandrel operably associated with said lower side ports for shutting off flow through said lower side ports while setting said well packer and for permitting fluid flow through said lower side ports and after setting said well packer; an annular cylinder on said body mandrel defining a fluid pressure chamber communicating with said central flow passage through said body mandrel; an annular piston in said cylinder operable responsive to fluid pressure directed into said annular chamber from said central flow passage; an annular piston extension connected with said piston and secured with said body mandrel for release from said body mandrel when fluid pressure on said piston exceeds a predetermined value; an annular setting sleeve releasably secured on said piston extension for engagement with a packer setting sleeve and releasable from said piston extension when the pressure on said piston exceeds a predetermined value for rendering said setting sleeve on said piston extension inoperable after the setting of said packer; a latch assembly on said body mandrel for releasably engaging said packer setting sleeve to restrain said packer setting sleeve against premature operation including a longitudinally movable annular collet having collet fingers held in locked positions when said piston extension is secured with said body mandrel and released from said locked position when said piston extension is released from said body mandrel for setting said packer sleeve, radially movable latch lugs supported by said collet for releasably engaging an internal locking recess of said packer sleeve, spring means biasing said latch lugs inwardly to release positions around said body mandrel, and means providing a release shoulder along said body mandrel permitting said latch lugs to move inwardly when said collet moves longitudinally with said packer sleeve after release by movement of said piston extension; and releasable coupling means on said body mandrel for releasably engaging the body mandrel of said packer while setting said packer in said well bore.

5. A service seal unit in accordance with claim 4 wherein said valve assembly controlling flow through said upper ports includes an outer longitudinally movable valve sleeve having a side port, spaced seal assemblies within said valve sleeve on said body mandrel above and below said upper side ports in said body mandrel, an internal valve control lug in said valve sleeve, and an internal J-slot mandrel on said body mandrel within said valve sleeve for directing said valve control lug to sequentially open and close said upper side ports responsive to longitudinal movement of said valve sleeve; means providing a longitudinal slot in said J-slot mandrel and a rotating lug in said valve sleeve engaged in said straight slot for rotating said body mandrel responsive to turning said valve sleeve; and said means for coupling said body mandrel with said body mandrel of said packer comprising an external J-slot body on said body mandrel of said service seal unit, said J-slot body having a J-slot formed therein for receiving a lug in said body mandrel of said packer for holding said seal unit in said packer and for releasing said seal unit from said packer responsive to rotation of said seal unit relative to said packer.

6. A service seal unit in accordance with claim 5 wherein said valve assembly operatively connected with said lower side ports in said body mandrel including a tubular valve seat member having an annular valve seat on an upper end thereof and side ports below said valve seat and means for releasably securing said seat member at a longitudinal position at which said valve seat is above said side ports in said service seal unit body mandrel, said seat member being movable to a lower end position at which said valve seat is below said side ports in said service seal unit body mandrel, said valve seat member being adapted for closing said central flow passage by dropping a ball valve to said valve seat through said central flow passage for pressuring said pressure chamber to set said packer and for movement to said lower end position responsive to a predetermined pressure on said ball valve to reopen said flow passage to said lower side ports for circulation to said well bore below said packer.

* * * * *